US008422092B2

(12) United States Patent
Suto et al.

(10) Patent No.: US 8,422,092 B2
(45) Date of Patent: Apr. 16, 2013

(54) ILLUMINATING DEVICE, IMAGE-READING APPARATUS, AND IMAGE-FORMING EQUIPMENT

(75) Inventors: Yasuhiro Suto, Osaka (JP); Mitsuharu Yoshimoto, Osaka (JP); Tomohiko Okada, Osaka (JP); Shohichi Fukutome, Osaka (JP); Hisashi Yamanaka, Osaka (JP); Kenji Nakanishi, Osaka (JP); Yoshihisa Yamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 765 days.

(21) Appl. No.: 12/616,824

(22) Filed: Nov. 12, 2009

(65) Prior Publication Data

US 2010/0124439 A1 May 20, 2010

(30) Foreign Application Priority Data

Nov. 14, 2008 (JP) ..... 2008-292574

(51) Int. Cl.
*H04N 1/04* (2006.01)

(52) U.S. Cl.
USPC ..... 358/475; 358/484; 358/483; 358/482; 358/496; 358/497; 358/474

(58) Field of Classification Search ..... 358/484, 358/475, 483, 482, 497, 474, 505, 509, 514, 358/496; 250/208.1, 216, 227.11, 234–236; 355/67; 399/220, 221
See application file for complete search history.

(56) References Cited

U.S. PATENT DOCUMENTS

| | | | | |
|---|---|---|---|---|
| 6,326,602 | B1 * | 12/2001 | Tabata | 250/208.1 |
| 6,556,317 | B2 * | 4/2003 | Tabata et al. | 358/509 |
| 7,088,905 | B1 * | 8/2006 | Nemoto et al. | 385/147 |
| 7,316,353 | B2 * | 1/2008 | Ikeda et al. | 235/454 |
| 2006/0152805 | A1 * | 7/2006 | Ikeda et al. | 359/515 |
| 2010/0177362 | A1 * | 7/2010 | Kim | 358/474 |
| 2012/0287484 | A1 * | 11/2012 | Shimoda | 358/475 |
| 2012/0307322 | A1 * | 12/2012 | Ozawa et al. | 358/475 |

FOREIGN PATENT DOCUMENTS

| | | |
|---|---|---|
| JP | 09-214675 | 8/1997 |
| JP | 2004-104480 | 4/2004 |

* cited by examiner

*Primary Examiner* — Cheukfan Lee
(74) *Attorney, Agent, or Firm* — Renner, Otto, Boisselle & Sklar, LLP

(57) ABSTRACT

An embodiment of the present invention provides an illuminating device that is disposed in an image-reading apparatus and image-forming equipment, including a light-source portion on one side; a light-source portion on the other side; and a long translucent light-guiding member having a light-discharging face long in a longitudinal direction thereof, and guiding light derived from the one light-source portion from one end face in the longitudinal direction, and light derived from the other light-source portion from the other end face in the longitudinal direction so that the guided light is irradiated to an object through the long light-discharging face; wherein the one and the other light-source portions are arranged such that positions of optical axes thereof differ from each other in a direction that is parallel to a light-irradiated face of the object and in a direction that is perpendicular to the longitudinal direction of the light-guiding member.

13 Claims, 11 Drawing Sheets

ILLUMINATING DEVICE, IMAGE-READING APPARATUS, AND IMAGE-FORMING EQUIPMENT

BACKGROUND OF THE INVENTION

This application claims priority under 35 U.S.C. §119(a) on Patent Application No. 2008-292574 filed in Japan on Nov. 14, 2008, the entire contents of which are herein incorporated by reference.

The present invention relates to an illuminating device that illuminates an object, an image-reading apparatus, and image-forming equipment.

In image-reading apparatuses that are arranged in image-forming equipment, such as a copier, a facsimile apparatus, and a digital compound machine, or image-reading apparatuses that are connected via a communication means such as a network to a computer, generally, reflected light from an original illuminated by an illuminating device including a light-source portion that illuminates an original, functioning as an object, is read as an image of the original.

For example, there are many conventional image-reading apparatuses, including: a light-source unit that has an illuminating device including a light-source portion for illuminating an original placed on a platen glass, and a first mirror; a second and a third mirror; an image formation lens; and an imaging element (e.g., a line sensor such as a CCD (charge coupled device)); in which light reflected by an original illuminated by the light-source portion passes through a slit disposed in a base member of a frame or the like in the illuminating device and travels via the first mirror, the second mirror, the third mirror, and then the image formation lens to form an image on the imaging element, thereby reading the image of the original.

This sort of image-reading apparatus is used as an image-reading means, for example, in the case where information on an image formed on an imaging element such as a CCD is processed by converting the information into an electric signal, and then transferred to image-forming equipment that prints image information or transmitted to a computer (e.g., a personal computer) that is connected to a network.

Conventional examples of a light-source portion that is disposed in an illuminating device include rod-like light-sources, such as a halogen lamp and a xenon lamp, and light-sources that use light-emitting elements, such as a light-emitting diode (LED).

For example, JP H9-214675A discloses an image-reading apparatus in which LED light-sources are respectively arranged on both ends in the longitudinal direction of a light-guiding member.

However, since light-sources that use light-emitting elements, such as an LED, have strong directional characteristics in a predetermined direction, this sort of image-reading apparatus as disclosed in JP H9-214675A is problematic as described below.

FIG. 10 is a view showing an example of the directional characteristics of a light-source E having strong directional characteristics in a predetermined direction. The light-source E shown in FIG. 10 exhibits characteristics in that a light flux in a predetermined direction (the arrow A direction in FIG. 10) of light B discharged from the light-source E is most intense, and light fluxes in directions other than the direction A are less intense. Here, usually, the direction in which a light flux is most intense is an optical axis.

FIGS. 11A to 11C are views illustrating a long translucent light-guiding member F in which light-emitting elements E' and E" are respectively arranged in two end faces F' and F" in the longitudinal direction. FIG. 11A shows a schematic side view of the light-guiding member F viewed from the outside on one side in a longitudinal direction Y. FIG. 11B shows a schematic side view of the light-guiding member F viewed from the outside on the other side in the longitudinal direction Y. FIG. 11C shows a schematic side view illustrating a light-reflection state in which light from the light-sources E' and E" having strong directional characteristics in predetermined directions along the longitudinal direction Y of the light-guiding member F is guided from the two end faces F' and F" in the longitudinal direction, and, thus, is irradiated from a long light-discharging face M along the longitudinal direction Y to an original G. Here, in FIGS. 11A to 11C, a glass disposed between the original and the light-sources is not shown.

In the configuration shown in FIGS. 11A to 11C, when light discharged from the light-sources E' and E" is incident from the two end faces F' and F" in the longitudinal direction Y of the light-guiding member F, the light is reflected in the light-guiding member F, and the reflected light is finally discharged from the light-discharging face M and irradiated to the original G.

In this configuration, when reflective loss occurring when optical axes L' and L" of the light-sources E' and E" are reflected in the light-guiding member F is suppressed, improvement in the amount of light irradiated from the light-discharging face M to the original G is significantly affected. That is to say, since the light fluxes in the optical axes L' and L" of the light-sources E' and E" are most intense, when reflective loss occurring when the optical axes L' and L" are reflected in the light-guiding member F is suppressed more, the amount of light irradiated from the light-discharging face M to the original G can be efficiently increased.

However, in the configuration shown in FIGS. 11A to 11C, since the light-sources E' and E" are arranged such that the optical axes L' and L" thereof are coaxially positioned, the optical axis L' from the light-source E' on one side is irradiated to the center of the light-source E" on the other side, and the optical axis L" from the light-source E" on the other side is irradiated to the light-source E' on one side. Thus, the light-reflectance ratios of the reflection faces that reflect light at the light-sources E' and E" are often lower than those of the other portions.

Accordingly, reflective loss occurs when the optical axis L' of the light-source E' on one side is reflected by the light-source E" on the other side, and reflective loss occurs when the optical axis L" of the light-source E" on the other side is reflected by the light-source E' on one side, and the amount of light irradiated from the light-discharging face M to the original G is reduced by the amount of reflective loss.

SUMMARY OF THE INVENTION

It is an object of the present invention to provide: an illuminating device, including a long translucent light-guiding member, having a light-discharging face long in a longitudinal direction thereof, and guiding light derived from one light-source portion from one end face in the longitudinal direction, and light derived from the other light-source portion from the other end face in the longitudinal direction so that the guided light is irradiated to an object through the long light-discharging face, and the amount of light that is irradiated from the light-discharging face to the object can be improved; an image-reading apparatus; and image-forming equipment.

In order to solve the above-described problem, the present invention is directed to an illuminating device that illuminates an object, comprising: a light-source portion on one side; a light-source portion on the other side; and a long translucent light-guiding member having a light-discharging face long in a longitudinal direction thereof, and guiding light derived from the one light-source portion from one end face in the longitudinal direction, and light derived from the other light-source portion from the other end face in the longitudinal direction so that the guided light is irradiated to an object through the long light-discharging face; wherein the one and the other light-source portions are arranged such that positions of optical axes thereof differ from each other.

Moreover, the present invention is directed to an image-reading apparatus including the illuminating device according to the present invention.

Moreover, the present invention is directed to image-forming equipment including the image-reading apparatus according to the present invention.

In the present invention, the light-source portion on one side and the light-source portion on the other side are light-source portions having strong directional characteristics in a predetermined direction, and a direction in which a light flux is most intense from amongst such directional characteristics is referred to as an optical axis.

According to the present invention, the one and the other light-source portions are arranged such that positions of optical axes thereof differ from each other. Thus, light from the one light-source portion can be reflected by a reflection face at the other end face in the longitudinal direction of the light-guiding member while the amount of light from the one light-source portion reflected by a reflection face of the other light-source portion is reduced, and light from the other light-source portion can be reflected by a reflection face at the one end face in the longitudinal direction of the light-guiding member while the amount of light from the other light-source portion reflected by a reflection face of the one light-source portion is reduced. Accordingly, in particular, it is possible to improve the light reflection efficiency when an optical axis that is introduced from the one light-source portion via the one end face in the longitudinal direction of the light-guiding member into the light-guiding member is reflected by the reflection face at the other end face in the longitudinal direction of the light-guiding member. Furthermore, it is possible to improve the light reflection efficiency when an optical axis that is introduced from the other light-source portion via the other end face in the longitudinal direction of the light-guiding member into the light-guiding member is reflected by the reflection face at the one end face in the longitudinal direction of the light-guiding member. Accordingly, it is possible to reduce the reflective loss occurring when the optical axis of the one light-source portion and the optical axis of the other light-source portion are reflected in the light-guiding member, and it is possible to accordingly increase the amount of light that is irradiated from the light-discharging face to the object.

In the present invention, it is preferable that the illuminating device further includes a main reflecting member that reflects light in the light-guiding member.

In the present invention, the light-source portion on one side and the light-source portion on the other side can be arranged as appropriate according to the shape of the light-guiding member (e.g., shapes such as a rectangle or a square when viewed from a side in the longitudinal direction of the light-guiding member).

More specifically, the following aspects can be given as examples of the arrangement of the one light-source portion and the other light-source portion:

(a) an aspect in which the one and the other light-source portions are arranged such that the positions of the optical axes thereof differ from each other in a direction that is perpendicular to a light-irradiated face of the object;

(b) an aspect in which the one and the other light-source portions are arranged such that the positions of the optical axes thereof differ from each other in a direction that is parallel to a light-irradiated face of the object and in a direction that is perpendicular to the longitudinal direction of the light-guiding member; and (c) an aspect in which (a) and (b) are combined.

In the present invention, both of the light-source portion on one side and the light-source portion on the other side may be configured as a single light-source, or at least one of the light-source portion on one side and the light-source portion on the other side may be configured as a light-source group including two or more light-sources.

In the case where the light-source portion is configured as a light-source group including two or more light-sources, it is possible to easily increase the amount of light from the light-source portion, and/or it is possible to discharge light having peaks at two or more different wavelengths from the light-source portion. Here, in the light-source portion configured as a light-source group including two or more light-sources, a direction in which a light flux is most intense from amongst the directional characteristics of the entire light discharged from the two or more light-sources (that is to say, the entire light discharged from each of the light-sources) may be referred to as an optical axis.

In the present invention, an aspect can be given as an example in which the illuminating device further includes: one light-source support on which the one light-source portion is set up; the other light-source support on which the other light-source portion is set up; and a base member; wherein the base member supports the one light-source support at the one end face in the longitudinal direction of the light-guiding member, and the other light-source support at the other end face in the longitudinal direction of the light-guiding member, and the one and the other light-source portions are respectively set up on the one and the other light-source supports so that the positions of the optical axes of the one and the other light-source portions differ from each other.

In this aspect, it is preferable that a reflecting member on one side is interposed between the one light-source support and the light-guiding member, and a reflecting member on the other side is interposed between the other light-source support and the light-guiding member.

According to such particulars, the reflection face at the one end face in the longitudinal direction of the light-guiding member can be a reflection face realized by the reflecting member on one side. Thus, it is possible to further improve the reflection efficiency when light that is introduced into the light-guiding member is reflected by the reflection face of the reflecting member on one side. Furthermore, the reflection face at the other end face in the longitudinal direction of the light-guiding member can be a reflection face realized by the reflecting member on the other side. Thus, it is possible to further improve the reflection efficiency when light that is introduced into the light-guiding member is reflected by the reflection face of the reflecting member on the other side. Accordingly, it is possible to further reduce the reflective loss occurring when the optical axes of the one and the other light-source portions are reflected in the light-guiding member, and it is possible to accordingly increase the amount of light that is irradiated from the light-discharging face to the object. In this case, the reflecting member itself may be made of a material having excellent thermal conductivity (e.g., a metal material), or the reflecting member may be made of a reflective film, and a member having excellent thermal conductivity (e.g., a metal member) that supports the reflective film. In this case, the reflecting member can provide not only a function of reflecting light but also a heat-radiating function of effectively radiating heat generated by the one and the other light-source portions.

In the present invention, the following aspects can be given as examples of the configuration in which two light-guiding members are provided. That is to say, the one light-source portion includes a first light-source portion and a second light-source portion on the one side, which are set up on the one light-source support; the other light-source portion includes a first light-source portion and a second light-source portion on the other side, which are set up on the other light-source support; the light-guiding member includes a first light-guiding member and a second light-guiding member that are arranged side by side in a direction that is perpendicular to the longitudinal direction such that these end faces in the longitudinal direction thereof are aligned with each other; the base member has a slit through which the light reflected from the object pass, between the first and the second light-guiding members, the slit extending in the longitudinal direction, and the base member supports the one light-source support at the one end face in the longitudinal direction of the first and the second light-guiding members, and the other light-source support at the other end face in the longitudinal direction of the first and the second light-guiding members; the main reflecting member includes a first main reflecting member that reflects light in the first light-guiding member and a second main reflecting member that reflects light in the second light-guiding member; the first light-source portions on the one side and on the other side are respectively arranged on the one and the other light-source supports such that positions of the optical axes of the first light-source portions respectively differ from each other; and the second light-source portions on the one side and on the other side are respectively arranged on the one and the other light-source supports such that positions of the optical axes of the second light-source portions respectively differ from each other.

According to such particulars, the slit is positioned between the first light-guiding member and the second light-guiding member. Thus, reflected light obtained when light from the light-discharging face of the first and the second light-guiding members is irradiated and reflected by the object can efficiently pass through the slit.

In the aspect in which two light-guiding members are provided in this manner, it is preferable that, when the first light-source portion on one side is closer to the object than the first light-source portion on the other side, the second light-source portion on the other side is closer to the object than the second light-source portion on one side, the second light-source portion on one side is positioned farther from the object than the first light-source portion on one side, and the first light-source portion on the other side is positioned farther from the object than the second light-source portion on the other side, or wherein, when the first light-source portion on one side is farther from the object than the first light-source portion on the other side, the second light-source portion on the other side is farther from the object than the second light-source portion on one side, the second light-source portion on one side is positioned closer to the object than the first light-source portion on one side, and the first light-source portion on the other side is positioned closer to the object than the second light-source portion on the other side.

According to such particulars, when the first light-source portion on one side is closer to the object than the first light-source portion on the other side, one side in the longitudinal direction of the object is brighter than the other side. In this state, the second light-source portion on the other side is closer to the object than the second light-source portion on one side, and, thus, light can be irradiated to the object in a state where the amount of light in the longitudinal direction is made uniform. That is to say, the second light-source portion on one side is farther from the object than the first light-source portion on one side, and, thus, the amount of light can be made uniform on one side in the longitudinal direction of the object. Moreover, the first light-source portion on the other side is farther from the object than the second light-source portion on the other side, and, thus, the amount of light can be made uniform on the other side in the longitudinal direction of the object.

Furthermore, when the first light-source portion on one side is farther from the object than the first light-source portion on the other side, one side in the longitudinal direction of the object is darker than the other side. In this state, the second light-source portion on the other side is farther from the object than the second light-source portion on one side, and, thus, light can be irradiated to the object in a state where the amount of light in the longitudinal direction is made uniform. That is to say, the second light-source portion on one side is closer to the object than the first light-source portion on one side, and, thus, the amount of light can be made uniform on one side in the longitudinal direction of the object. Moreover, the first light-source portion on the other side is closer to the object than the second light-source portion on the other side, and, thus, the amount of light can be made uniform on the other side in the longitudinal direction of the object.

Furthermore, in this configuration, when viewed from the longitudinal direction of the first and the second light-guiding members, a shape defined by four virtual lines is substantially rectangular or of isosceles trapezoid: the first virtual line connects centers of projection images of the first light-source portions on one side and on the other side; the second virtual line connects centers of projection images of the first light-source portion on the other side and the second light-source portion on one side; the third virtual line connects centers of projection images of the second light-source portions on one side and on the other side; and the fourth virtual line connects centers of projection images of the second light-source portion on the other side and the first light-source portion on one side.

Here, the term "isosceles trapezoid" refers to a trapezoid in which the sides that are not parallel to each other have the same length, and there are two pairs of adjacent angles with each pair being the same.

According to such particulars, the first and the second light-source portions on one side set up on the one light-source support and the first and the second light-source portions on the other side set up on the other light-source support are positioned such that the shape that is defined by four virtual lines is substantially rectangular or of isosceles trapezoid. Thus, the one light-source support can be used on the other side, and the other light-source support can be used on one side. That is to say, the one light-source support and the other light-source support can be used to substitute each other in use.

As described above, with the illuminating device, the image-reading apparatus, and the image-forming equipment according to the present invention, the one and the other light-source portions are arranged such that positions of optical axes thereof differ from each other, and, thus, it is possible to improve the amount of light that is irradiated from the light-discharging face to the object.

BRIEF DESCRIPTION OF THE DRAWINGS

FIGS. 6A and 6B are schematic views showing a light-source support in the light-source unit, wherein FIG. 6A is a front view of the light-source support, and FIG. 6B is a side view of the light-source support.

FIGS. 7A and 7B are schematic side views of the main portions of the light-source unit viewed from the outside on both sides in the longitudinal direction, wherein FIG. 7A is a view from the outside on one side, and FIG. 7B is a view from the outside on the other side.

FIGS. 8A and 8B are schematic cross-sectional views illustrating a light-reflection state in a first and a second light-guiding member, wherein FIG. 8A is a view showing a light-reflection state in which light from two first light-source portions in which light-emitting faces oppose each other is guided from both end faces in the longitudinal direction, and, thus, is irradiated from a light-discharging face to an original, and FIG. 8B is a view showing a light-reflection state in which light from two second light-source portions in which light-emitting faces oppose each other is guided from both end faces in the longitudinal direction, and, thus, is irradiated from the light-discharging face to the original.

FIGS. 9A to 9C are views showing an example in which all of the first light-source portions and the second light-source portions are realized as light-source groups including two or more LED elements, wherein FIG. 9A is a schematic side view of the main portions of the light-source unit viewed from the outside on one side in the longitudinal direction, FIG. 9B is a view showing an example of the directional characteristics of light-source groups on one side including two or more LED elements, and FIG. 9C is a view showing an example of the directional characteristics of light-source groups on the other side including two or more LED elements.

FIGS. 11A to 11C are views illustrating a long translucent light-guiding member in which light-emitting elements are respectively arranged in both end faces in the longitudinal direction, wherein FIG. 11A is a schematic side view of the light-guiding member viewed from the outside on one side in the longitudinal direction, FIG. 11B is a schematic side view of the light-guiding member viewed from the outside on the other side in the longitudinal direction, and FIG. 11C is a schematic side view illustrating a light-reflection state in which light from the light-sources having strong directional characteristics in predetermined directions along the longitudinal direction of the light-guiding member is guided from both end faces in the longitudinal direction, and, thus, is irradiated from a long light-discharging face along the longitudinal direction to an original.

DESCRIPTION OF THE PREFERRED EMBODIMENTS

Hereinafter, embodiments of the present invention will be described with reference to the drawings. It should be noted that the following embodiments are specific examples of the present invention and are not of a nature that limits the technical scope of the present invention.

Figure 1:
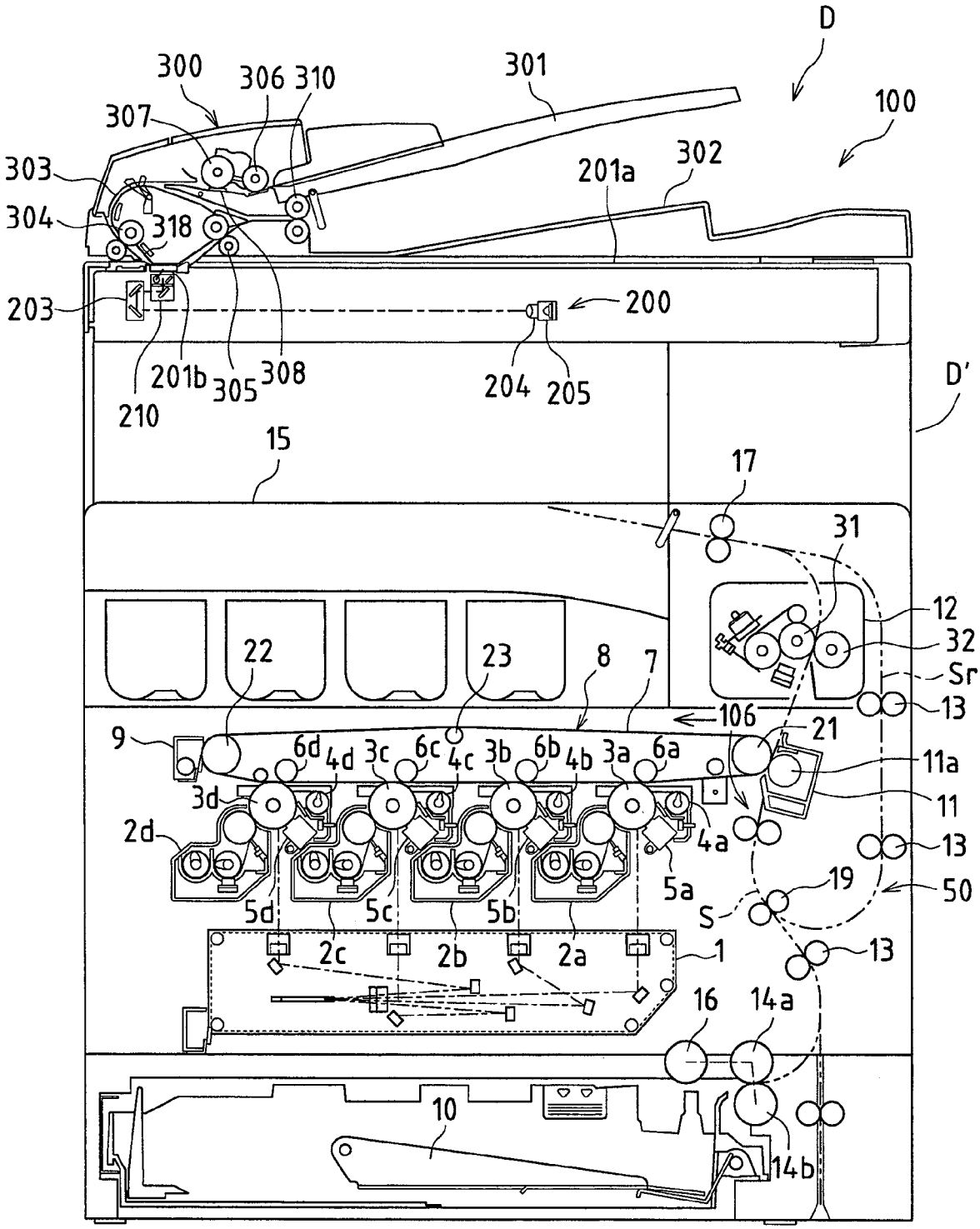
FIG. 1 is a side view schematically showing image-forming equipment including an image-reading apparatus to which an embodiment of an illuminating device according to the present invention is applied.

FIG. 1 is a side view schematically showing image-forming equipment D including an image-reading apparatus 100 to which an embodiment of an illuminating device according to the present invention is applied.

The image-forming equipment D shown in FIG. 1 includes the image-reading apparatus 100 that reads an image of an original G functioning as an object (see FIG. 2, which will be described later), and an apparatus main body D' that records an image of the original G read by the image-reading apparatus 100 or an image received from the outside, as a color or monochrome image on a recording sheet, such as plain paper.

Regarding the Overall Configuration of the Image-Forming Equipment

The apparatus main body D' of the image-forming equipment D includes an exposure apparatus 1, development apparatuses 2 (2*a*, 2*b*, 2*c*, and 2*d*), photosensitive drums 3 (3*a*, 3*b*, 3*c*, and 3*d*) functioning as image carriers, charging units 5 (5*a*, 5*b*, 5*c*, and 5*d*), cleaner apparatuses 4 (4*a*, 4*b*, 4*c*, and 4*d*), an intermediate transfer belt apparatus 8 that includes intermediate transfer rollers 6 (6*a*, 6*b*, 6*c*, and 6*d*) functioning as transferring portions, a fixing apparatus 12, a sheet-transporting apparatus 50, a paper feed tray 10 functioning as a paper-feeding portion, and a paper discharge tray 15 functioning as a paper-discharging portion.

Image data processed in the apparatus main body D' of the image-forming equipment D corresponds to a color image using colors consisting of black (K), cyan (C), magenta (M), and yellow (Y), or corresponds to a monochrome image using a monochrome color (e.g., black). Accordingly, four development apparatuses 2 (2*a*, 2*b*, 2*c*, and 2*d*), four photosensitive drums 3 (3*a*, 3*b*, 3*c*, and 3*d*), four charging units 5 (5*a*, 5*b*, 5*c*, and 5*d*), four cleaner apparatuses 4 (4*a*, 4*b*, 4*c*, and 4*d*), and four intermediate transfer rollers 6 (6*a*, 6*b*, 6*c*, and 6*d*) are arranged such that four types of images corresponding to the respective colors are formed. Among the symbols a to d attached to the end of the reference numerals, the symbol a corresponds to black, b to cyan, c to magenta, and d to yellow, and four image stations are formed. In the following description, the symbols a to d attached to the end of the reference numerals are omitted.

The photosensitive drums 3 are arranged substantially in the center in the vertical direction of the apparatus main body D'.

The charging units 5 are a charging means for uniformly charging the surface of the photosensitive drums 3 to a predetermined potential. As the charging units 5, a contact-type charging unit using a roller or brush, or a charger-type charging unit is used.

The exposure apparatus 1 in this example is a laser scanning unit (LSU) including laser diodes and reflecting mirrors, and causes the charged surface of the photosensitive drums 3 to be exposed to light according to image data to form electrostatic latent images according to the image data on the surface.

The development apparatuses 2 develop the electrostatic latent images formed on the photosensitive drums 3 with toners (K, C, M, and Y). The cleaner apparatuses 4 remove and recover toner remaining on the surface of the photosensitive drums 3 after development and image transfer.

In addition to the intermediate transfer rollers 6, the intermediate transfer belt apparatus 8 disposed above the photosensitive drums 3 includes an intermediate transfer belt 7, an intermediate transfer belt-driving roller 21, an idler roller 22, a tension roller 23, and an intermediate transfer belt-cleaning apparatus 9.

The roller members such as the intermediate transfer belt-driving roller 21, the intermediate transfer rollers 6, the idler roller 22, and the tension roller 23 support the intermediate transfer belt 7 in a tensioned state, and circumferentially move the intermediate transfer belt 7 in a predetermined sheet transport direction (the arrow direction in FIG. 1).

The intermediate transfer rollers 6 are supported in a rotatable manner inside the intermediate transfer belt 7, and pressed via the intermediate transfer belt 7 against the photosensitive drums 3.

The intermediate transfer belt 7 is disposed so as to be in contact with each of the photosensitive drums 3. The toner images on the surfaces of the photosensitive drums 3 are sequentially transferred to the intermediate transfer belt 7 and superimposed, and, thus, a color toner image (toner images of the respective colors) is formed. The transfer belt 7 in this example is formed as an endless belt using a film having a thickness of approximately 100 to 150 μm.

The toner images are transferred from the photosensitive drums 3 to the intermediate transfer belt 7, using the intermediate transfer rollers 6 pressed against the inner side (the back face) of the intermediate transfer belt 7. In order to transfer the toner images, a high-voltage transfer bias (e.g., a high voltage of the opposite polarity (+) to the charge polarity (−) of the toner) is applied to the intermediate transfer rollers 6. The intermediate transfer rollers 6 in this example are rollers including a base that is made of a metal shaft (e.g., stainless steel) having a diameter of 8 to 10 mm, and an electrically conductive elastic material (e.g., EPDM, urethane foam, etc.) that covers the surface of the shaft. The electrically conductive elastic material enables a high voltage to be uniformly applied to a recording sheet.

The apparatus main body D' of the image-forming equipment D further includes a secondary transfer apparatus 11 that includes a transfer roller 11*a* functioning as a transferring portion. The transfer roller 11*a* is in contact with the outer side of the intermediate transfer belt 7.

In this manner, the toner images on the surfaces of the respective photosensitive drums 3 are superimposed on the intermediate transfer belt 7 to form a color toner image represented by the image data. The thus superimposed toner images of the respective colors are transported together with the intermediate transfer belt 7, and transferred to a recording sheet by the secondary transfer apparatus 11.

The intermediate transfer belt 7 and the transfer roller 11*a* of the secondary transfer apparatus 11 are pressed against each other to form a nip region. Furthermore, a voltage (e.g., a high voltage of the opposite polarity (+) to the charge polarity (−) of the toner) for transferring toner images of the respective colors on the intermediate transfer belt 7 to a recording sheet is applied to the transfer roller 11*a* of the secondary transfer apparatus 11. In order to constantly maintain the nip region, one of the transfer roller 11*a* of the secondary transfer apparatus 11 and the intermediate transfer belt-driving roller 21 is made of a hard material (metal, etc.), and the other is made of a soft material such as an elastic roller (an elastic rubber roller, a foamable resin roller, etc.).

The toner images on the intermediate transfer belt 7 may not be completely transferred by the secondary transfer apparatus 11 to a recording sheet, and toner may remain on the intermediate transfer belt 7. This residual toner causes toner color mixing in the following step. Thus, residual toner is removed and recovered by the intermediate transfer belt-cleaning apparatus 9. The intermediate transfer belt-cleaning apparatus 9 includes, for example, a cleaning blade that is in contact with the intermediate transfer belt 7 as a cleaning member, and the cleaning blade can remove and recover residual toner. The idler roller 22 supports the intermediate transfer belt 7 from the inner side (the back face), and the cleaning blade is in contact with the intermediate transfer belt 7 so as to press the idler roller 22 from the outside.

The paper feed tray 10 is a tray in which recording sheets are stored, and is disposed below an image-forming portion of the apparatus main body D'. Furthermore, the paper discharge tray 15 disposed above the image-forming portion is a tray in which printed recording sheets are placed facedown.

Furthermore, the apparatus main body D' includes the sheet-transporting apparatus 50 for transporting a recording sheet in the paper feed tray 10 via the secondary transfer apparatus 11 and the fixing apparatus 12 to the paper discharge tray 15. The sheet-transporting apparatus 50 has an S-shaped sheet transport path S, and transporting members such as a pickup roller 16, a separator roller 14*a*, a separation roller 14*b*, transport rollers 13, a pre-registration roller pair 19, a registration roller pair 106, the fixing apparatus 12, and paper discharge rollers 17 are arranged along the sheet transport path S.

The pickup roller 16 is a draw-in roller that is disposed in an end portion of the paper feed tray 10 on the downstream side in the sheet transport direction and that feeds recording sheets sheet by sheet from the paper feed tray 10 into the sheet transport path S. The separator roller 14*a* causes a recording sheet to pass between the separator roller 14*a* and the separation roller 14*b* so as to separate recording sheets sheet by sheet, and transports that recording sheet into the sheet transport path S. The transport rollers 13 and the pre-registration roller pair 19 are small rollers for promoting and assisting transportation of a recording sheet. The transport rollers 13 are arranged in a plurality of positions along the sheet transport path S. The pre-registration roller pair 19 is disposed near the registration roller pair 106 on the upstream side in the sheet transport direction, and transports the recording sheet to the registration roller pair 106.

The fixing apparatus 12 receives the recording sheet to which the toner images have been transferred, and transports the recording sheet such that the recording sheet is held between a heat roller 31 and a pressure roller 32.

The heat roller 31 is temperature controlled so as to be at a predetermined fixing temperature, and has the functions of melting, mixing, and pressing the toner images transferred to the recording sheet such that the images are thermally fixed to the recording sheet by subjecting the recording sheet to thermocompression bonding in cooperation with the pressure roller 32.

The recording sheet to which the toner images of the respective colors have been fixed is discharged by the paper discharge rollers 17 onto the paper discharge tray 15.

Also, a monochrome image can be formed using only one of the four image-forming stations, and transferred to the intermediate transfer belt 7 of the intermediate transfer belt apparatus 8. This monochrome image is also transferred from the intermediate transfer belt 7 to a recording sheet and fixed onto the recording sheet as in the case of the color image.

Furthermore, in the case where an image is formed not only on the front face of a recording sheet but also on both faces, after an image on the front face of the recording sheet is fixed by the fixing apparatus 12, the paper discharge rollers 17 are stopped and then rotated in reverse during transportation of the recording sheet using the paper discharge rollers 17 of the sheet transport path S, the recording sheet is passed through a front-back reversing path Sr where the front and the back of the recording sheet are reversed, and then the recording sheet is guided again to the registration roller pair 106. Subsequently, as in the case of the front face of the recording sheet, an image is recorded and fixed to the back face of the recording sheet, and the recording sheet is discharged onto the paper discharge tray 15.

Regarding the Overall Configuration of the Image-Reading Apparatus

Figure 2:
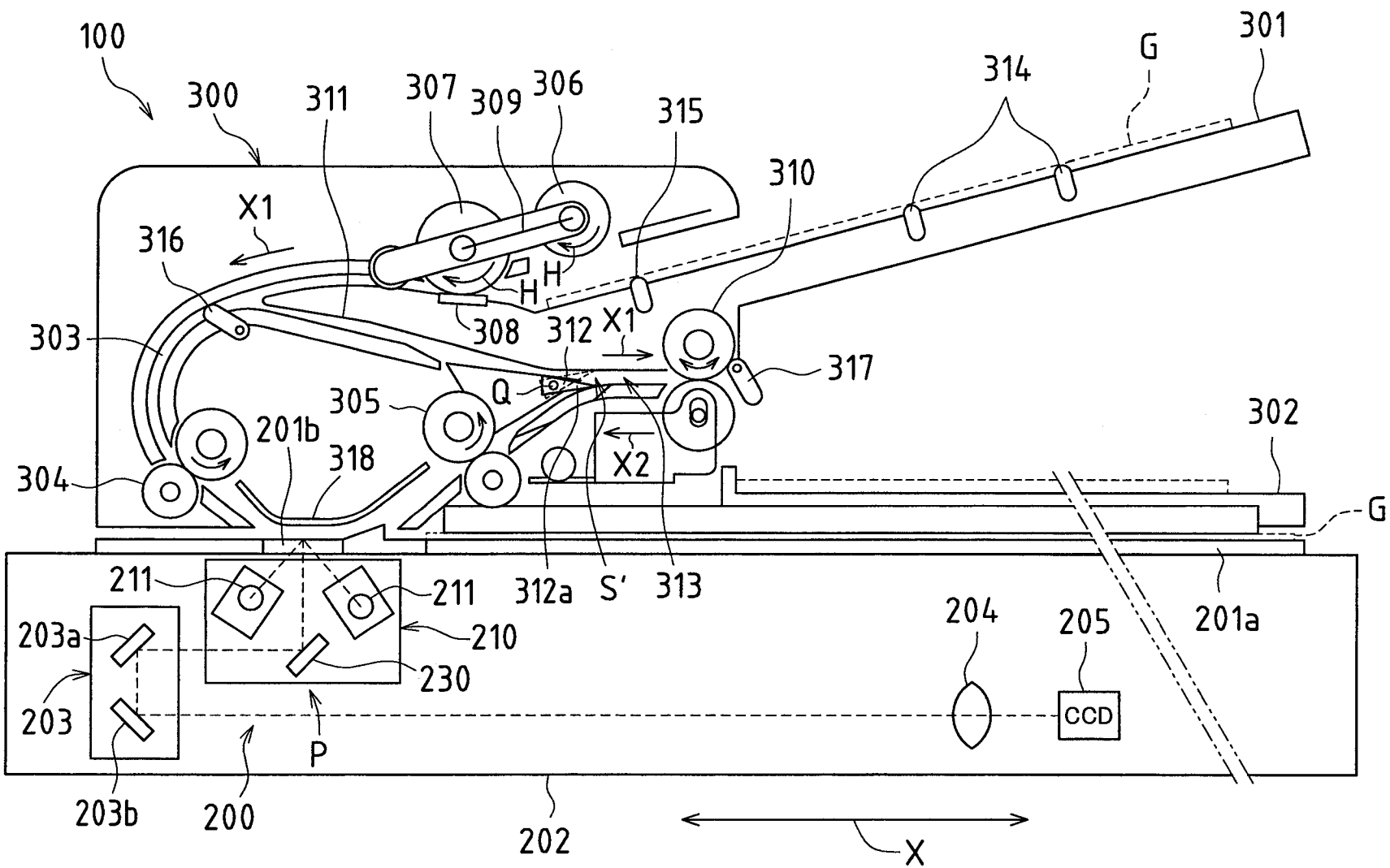
FIG. 2 is a schematic vertical cross-sectional view of the image-reading apparatus shown in FIG. 1.
Figure 3:
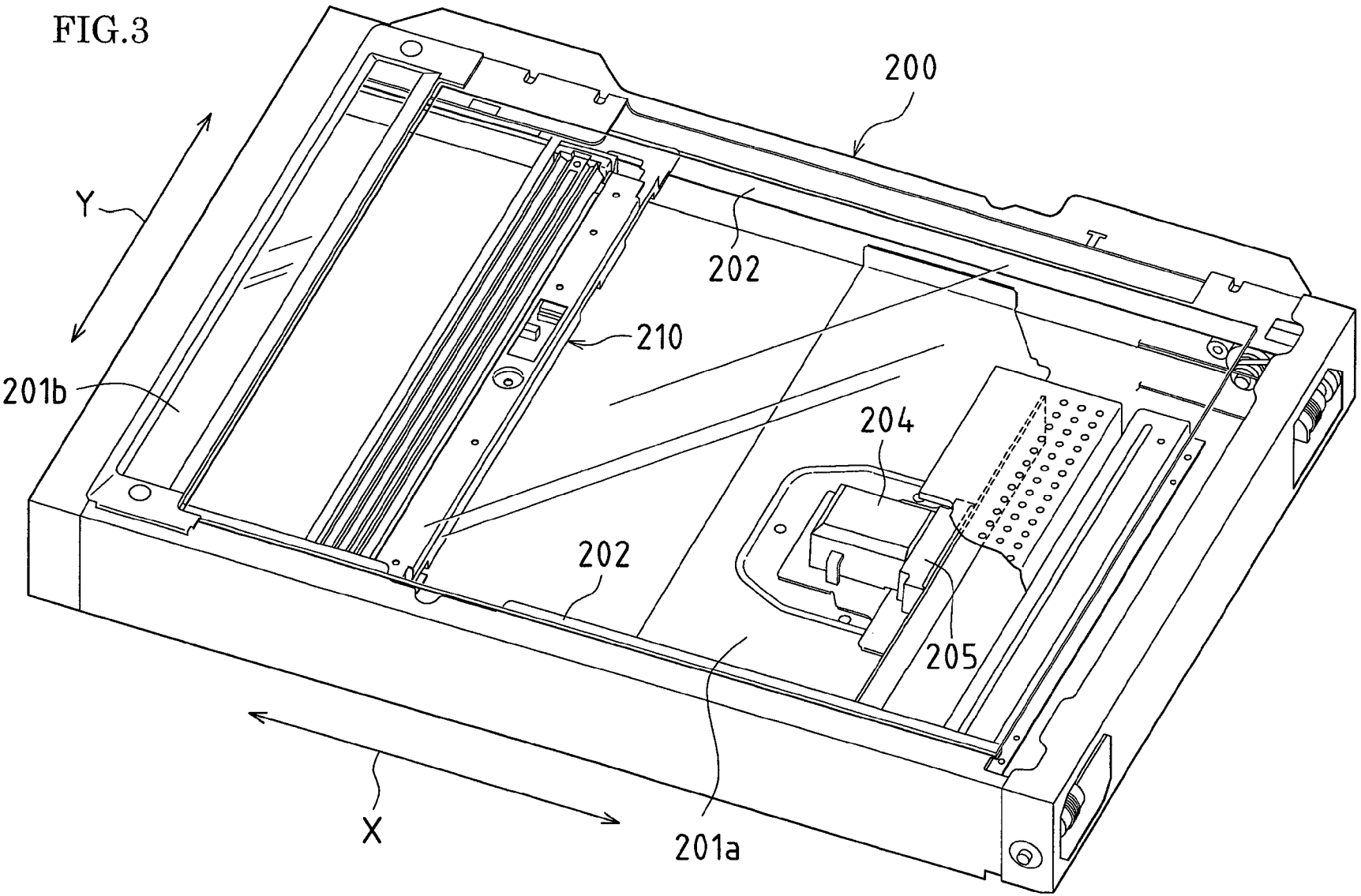
FIG. 3 is a schematic perspective view of the image-reading apparatus shown in FIG. 1.

FIG. 2 is a schematic vertical cross-sectional view of the image-reading apparatus 100 shown in FIG. 1. FIG. 3 is a schematic perspective view of the image-reading apparatus 100 shown in FIG. 1.

The image-reading apparatus 100 shown in FIGS. 1 to 3 is configured so as to read an image of an original while securing the original G using a secured original mode, or to read an image of an original while moving the original G using a moving original mode.

That is to say, the image-reading apparatus 100 has a secured original-reading configuration in which, in a state where the original G placed on a platen glass 201*a* is illuminated by a light-source portion 211 via the glass 201*a*, and the light-source portion 211 is being moved in a sub-scanning direction (the arrow X direction in FIGS. 2 and 3), reflected light from the original G illuminated by the light-source portion 211 is scanned in a main-scanning direction (the arrow Y direction in FIG. 3), thereby reading an image of the original, and a moving original-reading configuration in which, in a state where the original G that is being transported by an automated original feeder apparatus 300 in the sub-scanning direction X so as to pass over an original-reading glass 201*b* is illuminated by the light-source portion 211 positioned at a home position P in an original-reading portion 200 via the glass 201*b*, reflected light from the original G illuminated by the light-source portion 211 is scanned in the main-scanning direction Y, thereby reading an image of the original. FIG. 2 shows a state in which the light-source portion 211 is positioned at the home position P. In FIG. 3, the automated original feeder apparatus 300, a mirror unit 203 (described later), and the like are not shown.

More specifically, the original-reading portion 200 includes the platen glass 201*a*, a light-source unit 210 (an example of the illuminating device) including the light-source portion 211, an optical system drive portion (not shown) that moves the light-source portion 211, the mirror unit 203, a condensing lens 204, and an imaging element (a CCD, in this example) 205, the light-source portion 211 is accommodated in the light-source unit 210, and these constituent components accommodated in a metal frame (hereinafter, referred to as a "frame") 202. Here, the light-source unit 210 will be described later in detail.

The platen glass 201*a* is made of a transparent glass plate, and both end portions thereof in the main-scanning direction Y are placed on the frame 202. Here, the automated original feeder apparatus 300 can be opened and closed with respect to the original-reading portion 200 about an axis in the sub-scanning direction X (e.g., the automated original feeder apparatus 300 is axially supported by a hinge), and a lower face thereof also functions as an original-pressing member that presses the original G placed on the platen glass 201*a* of the original-reading portion 200 from above.

The mirror unit 203 includes a second mirror 203*a*, a third mirror 203*b*, and a supporting member (not shown). The supporting member supports the second mirror 203*a* such that light from a first mirror 230 in the light-source unit 210 is reflected and guided to the third mirror 203*b*, and supports the third mirror 203*b* such that light from the second mirror 203*a* is reflected and guided to the condensing lens 204. The condensing lens 204 condenses light from the third mirror 203*b* to the imaging element 205. The imaging element 205 converts light from the condensing lens 204 (image light of the original) into an electric signal as image data.

Furthermore, the optical system drive portion is configured so as to move the light-source unit 210 in the sub-scanning direction X at a constant speed, and move the mirror unit 203 in a similar manner in the sub-scanning direction X at a moving speed that is ½ the moving speed of the light-source unit 210.

In this example, the original-reading portion 200 corresponds not only to the secured original mode but also to the moving original mode, and includes the original-reading glass 201*b*. Accordingly, the optical system drive portion is configured so as to cause the light-source unit 210 to be positioned at a predetermined home position P below the original-reading glass 201*b*. Here, the platen glass 201*a* and the original-reading glass 201*b* are independent of each other in this example, but may be integrally formed.

The automated original feeder apparatus 300 includes an original tray 301 on which the original G is placed for transportation, a discharge tray 302 that is disposed below the original tray 301, a first transport path 303 that connects the original tray 301 and the discharge tray 302, and two transport roller pairs consisting of an upstream transport roller pair 304 and a downstream transport roller pair 305 that transport the original G respectively on the upstream side and on the downstream side in the transport direction X1 of the original G with respect to the original-reading glass 201*b*. That is to say, the upstream transport roller pair 304, the original-reading glass 201*b*, and the downstream transport roller pair 305 are arranged in this order in the transport direction X1. Furthermore, the original-reading glass 201*b* is substantially horizontally disposed so as to define a transport wall of the first transport path 303.

The automated original feeder apparatus 300 further includes a pickup roller 306, a separator roller 307, and a separation member 308 such as a separation pad.

The pickup roller 306 sends the original G placed on the original tray 301 from the original tray 301 in the transport direction X1 into the first transport path 303. The separator roller 307 is disposed on the downstream side in the transport direction X1 of the pickup roller 306, and transports the original G that has been sent by the pickup roller 306 further to the downstream side in the transport direction X1 while sandwiching the original G with the separation member 308. The separation member 308 sorts (separates) the originals G such that only one sheet of original G is transported between the separation member 308 and the separator roller 307 in a state where the separation member 308 is disposed in opposition to the separator roller 307.

The thus configured automated original feeder apparatus 300 uses the pickup roller 306 to transport the originals G between the separator roller 307 and the separation member 308 where the originals G are sorted and separated, and then rotationally drives the separator roller 307 to transport the originals G sheet by sheet. Then, the originals G transported by the separator roller 307 can be guided along the first transport path 303 and fed sheet by sheet toward the upstream transport roller pair 304.

More specifically, the pickup roller 306 can be brought into and out of contact with the original G placed on the original tray 301 by a pickup roller drive portion (not shown). Furthermore, the pickup roller 306 is coupled to the separator roller 307 via a drive transmission means 309 including an endless belt and the like so as to rotate in the same direction as the separator roller 307. When there is a request to read the original G, the pickup roller 306 and the separator roller 307 are rotationally driven by an original feeder drive portion (not shown) in a direction (the arrow H direction in FIG. 2) in which the original G is transported in the transport direction X1.

In this embodiment, the automated original feeder apparatus 300 is configured such that, after the original G is reversed such that its front and back are inverted, and transport is performed in a state where one face of the original G can be read, the original G is reversed such that its front and back are inverted, and transport is performed in a state where the other face of the original G can be read.

More specifically, in addition to the above-described configuration, the automated original feeder apparatus 300 further includes a reversing roller pair 310, a second transport path 311, and a switching claw 312.

The first transport path 303 is formed in the shape of a loop such that the original G is transported from the separator roller 307, via the upstream transport roller pair 304, the original-reading glass 201*b*, the downstream transport roller pair 305, and the reversing roller pair 310, to the discharge tray 302. The reversing roller pair 310 is disposed on the downstream side in the transport direction X1 of the downstream transport roller pair 305, and transports the original G that has been transported from the downstream transport roller pair 305 such that the trailing edge (edge on the upstream side in the transport direction X1) is positioned in front. The second transport path 311 branches from a branching portion S' between the reversing roller pair 310 and the downstream transport roller pair 305, and guides the original G that has been transported by the reversing roller pair 310 such that the trailing edge is positioned in front, to the upstream side in the transport direction X1 of the upstream transport roller pair 304 of the first transport path 303 in order to cause the original G to be reversed such that its front and back are inverted. A switchback transport path 313 is formed between the reversing roller pair 310 of the first transport path 303 and the branching portion S'. The switchback transport path 313 is a transport path that can transport the original G with rotation of the reversing roller pair 310 in a forward direction (the transport direction X1 of the original G) and that can transport the original G in reverse with rotation in a reverse direction.

The switching claw 312 is disposed at the branching portion S', and is configured so as to be capable of taking a first switching posture in which the original G is guided from the reversing roller pair 310 via the second transport path 311 to the upstream transport roller pair 304 and a second switching posture in which the original G is guided from the downstream transport roller pair 305 via the switchback transport path 313 to the reversing roller pair 310.

In this example, in a normal state, the switching claw 312 is disposed so as to directly connect the switchback transport path 313 and the second transport path 311 (the first switching posture, see the solid line in FIG. 2), and when the original G in which an image of the original has been read by the original-reading portion 200 is transported in the transport direction X1, a leading edge of the original G (edge on the downstream side in the transport direction X1) pushes up against the switching claw 312, so that the original G is guided to the switchback transport path 313 (the second switching posture, see the broken line in FIG. 2). The switching claw 312 freely pivots on a pivot shaft Q in an axial direction of the reversing roller pair 310 such that a claw portion 312*a* drops under its own weight and blocks the first transport path 303 between the downstream transport roller pair 305 and the reversing roller pair 310 to take the first switching posture. The switching claw 312 is configured such that, when the trailing edge of the original G is positioned in the switchback transport path 313, and the original G is transported in reverse in a reverse transport direction (the arrow X2 direction in FIG. 2) that is an opposite direction to the transport direction X1 of the original G by the reversing roller pair 310 rotating in the reverse direction, the original G is guided to the second transport path 311.

Here, the size of the original G placed on the original tray 301 is detected by an original size sensor 314 that is disposed in an original placing portion of the original tray 301. The presence or absence of the original G placed on the original tray 301 is detected by an original presence- or absence-detecting sensor 315 that is disposed near the pickup roller 306 of the original placing portion of the original tray 301. Furthermore, in a stopped state, the upstream transport roller pair 304 contacts against and adjusts the leading edge of the original G that has been transported by the separator roller 307, and is rotationally driven according to the reading timing. The thus transported original G is detected by a transport sensor 316 that is disposed on the downstream side of the second transport path 311 and on the upstream side of the upstream transport roller pair 304 in the transport direction X1 of the first transport path 303. Furthermore, the original G that is discharged by the reversing roller pair 310 is detected by a discharge sensor 317 that is disposed near the reversing roller pair 310, on the side closer to the discharge point than the reversing roller pair 310. Here, the transport roller pairs 304 and 305, the reversing roller pair 310, and the like are driven by drive portions (not shown) for the transport system.

Furthermore, in this embodiment, the automated original feeder apparatus 300 further includes a reading guide 318 that opposes the original-reading glass 201*b* with the transported original G interposed therebetween.

In the image-reading apparatus 100 described above, in the case where a command to read an image of the original G in the secured original mode is given, the light-source unit 210 moves to one side in the sub-scanning direction X at a constant speed to scan an image of the original G while irradiating light onto the original G placed on the platen glass 201*a* via the platen glass 201*a*, and, at the same time, the mirror unit 203 moves in a similar manner to one side in the sub-scanning direction X at a moving speed that is ½ the moving speed of the light-source unit 210.

After the reflected light from the original G illuminated by the light-source unit 210 is reflected by the first mirror 230 that is disposed in the light-source unit 210, the optical path thereof is re-directed by 180° by the second and the third mirrors 203*a* and 203*b* of the mirror unit 203, and the reflected light from the third mirror 203*b* forms an image via the condensing lens 204 on the imaging element 205 where image light from the original is read and converted to electric image data.

On the other hand, in the case where a command to read an image of the original G in the moving original mode is given, while the light-source unit 210 and the mirror unit 203 are stopped at the positions shown in FIG. 2, the automated original feeder apparatus 300 transports the original G to one side in the sub-scanning direction X such that the original G passes over the positions shown in FIG. 2. That is to say, the originals G placed on the original tray 301 are taken out by the pickup roller 306, separated sheet by sheet by the separator roller 307 and the separation member 308, and transported into the first transport path 303. After transport of the original G is confirmed by the transport sensor 316, the leading edge of the original G that has been transported into the first transport path 303 is adjusted by the upstream transport roller pair 304 in order to prevent diagonal movement, the original G is sent out at a prescribed reading timing, its front and back are reversed, and then the original G is transported to the original-reading glass 201*b*.

Then, light from the light-source unit 210 is irradiated via the original-reading glass 201*b* onto one face of the original G that has passed over the original-reading glass 201*b*, and reflected by that one face. As in the case of the secured original mode, after the reflected light from one face of the original G is reflected by the first mirror 230, the optical path thereof is re-directed by 180° by the second and the third mirrors 203*a* and 203*b* of the mirror unit 203, and the reflected light forms an image via the condensing lens 204 on the imaging element 205 where the image of the original is read and converted to electric image data. Here, this reading operation of the imaging element 205 is similar to that in double-face reading, which will be described later, and a description thereof is omitted.

The original G that has been completely read is withdrawn from the original-reading glass 201*b* by the downstream transport roller pair 305 and discharged via the switchback transport path 313 of the first transport path 303 onto the discharge tray 302 by the reversing roller pair 310 that can rotate in reverse.

Furthermore, in the case where both one face and the other face of the original G are to be read, the original G, one face of which has been read, is not discharged to the discharge tray 302, but is transported such that the trailing edge of the original G is positioned in the switchback transport path 313, transported in reverse in the reverse transport direction X2 by the reversing roller pair 310 rotating in the reverse direction, and guided to the second transport path 311 by the switching claw 312 that is in the first switching posture. The original G that has been guided to the second transport path 311 returns again to the first transport path 303 via the second transport path 311, and, thus, its front and back are reversed. Then, the original G is transported by the upstream transport roller pair 304 and passes over the original-reading glass 201*b*, and, thus, the other face is read. The original G, both faces of which have been completely read in this manner, returns again to the first transport path 303, and, thus, its front and back are reversed. Then, the original G is transported by the transport roller pairs 304 and 305, and passes through the switchback transport path 313 of the first transport path 303, and is discharged onto the discharge tray 302 via the reversing roller pair 310 rotating in the forward direction.

Description of Characteristic Aspects of the Present Invention

The light-source unit according to an embodiment of the present invention can be configured as a unit that includes one, or two or more light-guiding members. Here, the light-source unit 210 that includes two first and second light-guiding members 213*a* and 213*b* will be described as an example.

Figure 4:
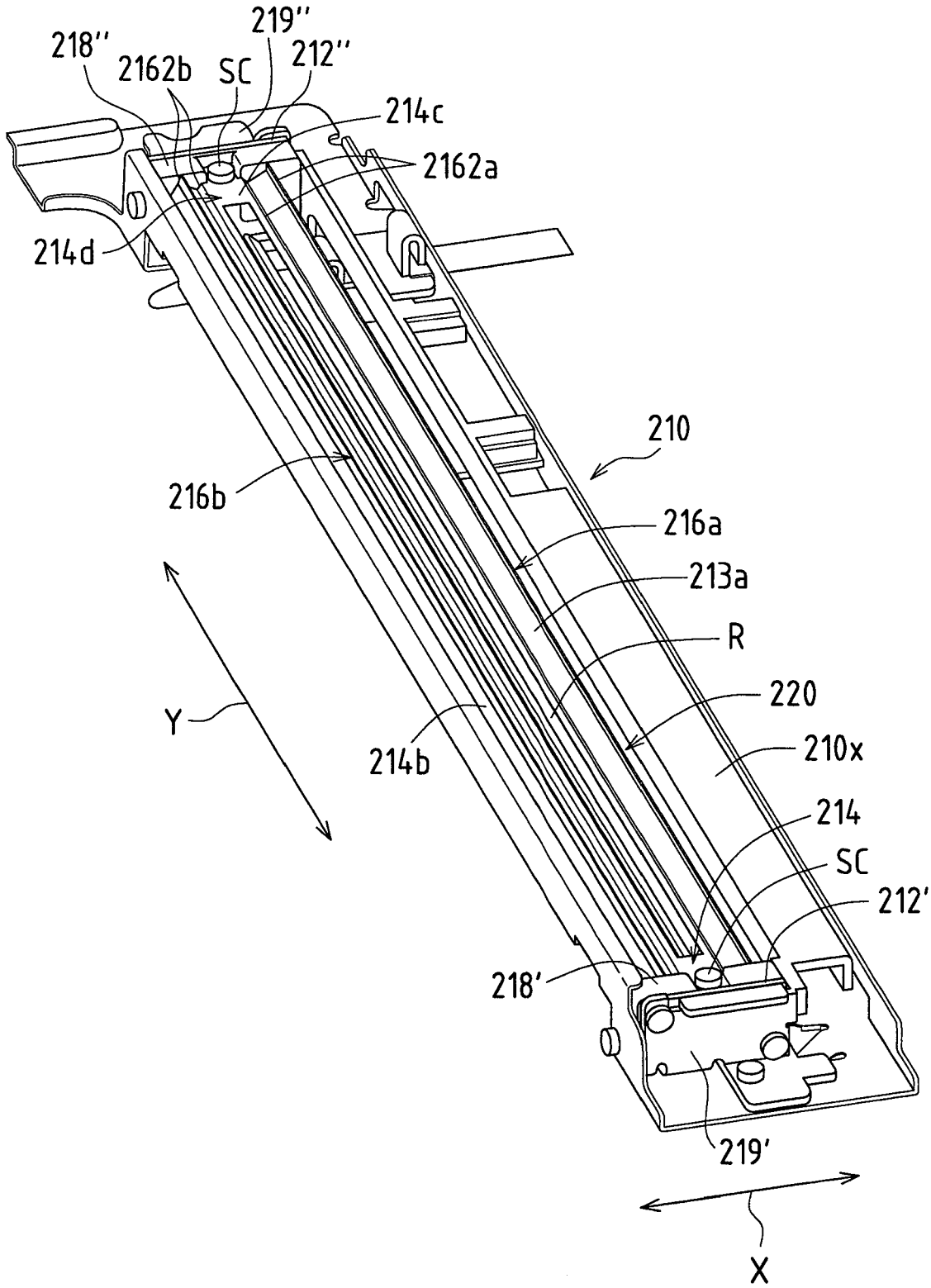
FIG. 4 is a schematic perspective view showing a schematic configuration of a light-source unit according to this embodiment.
Figure 5:
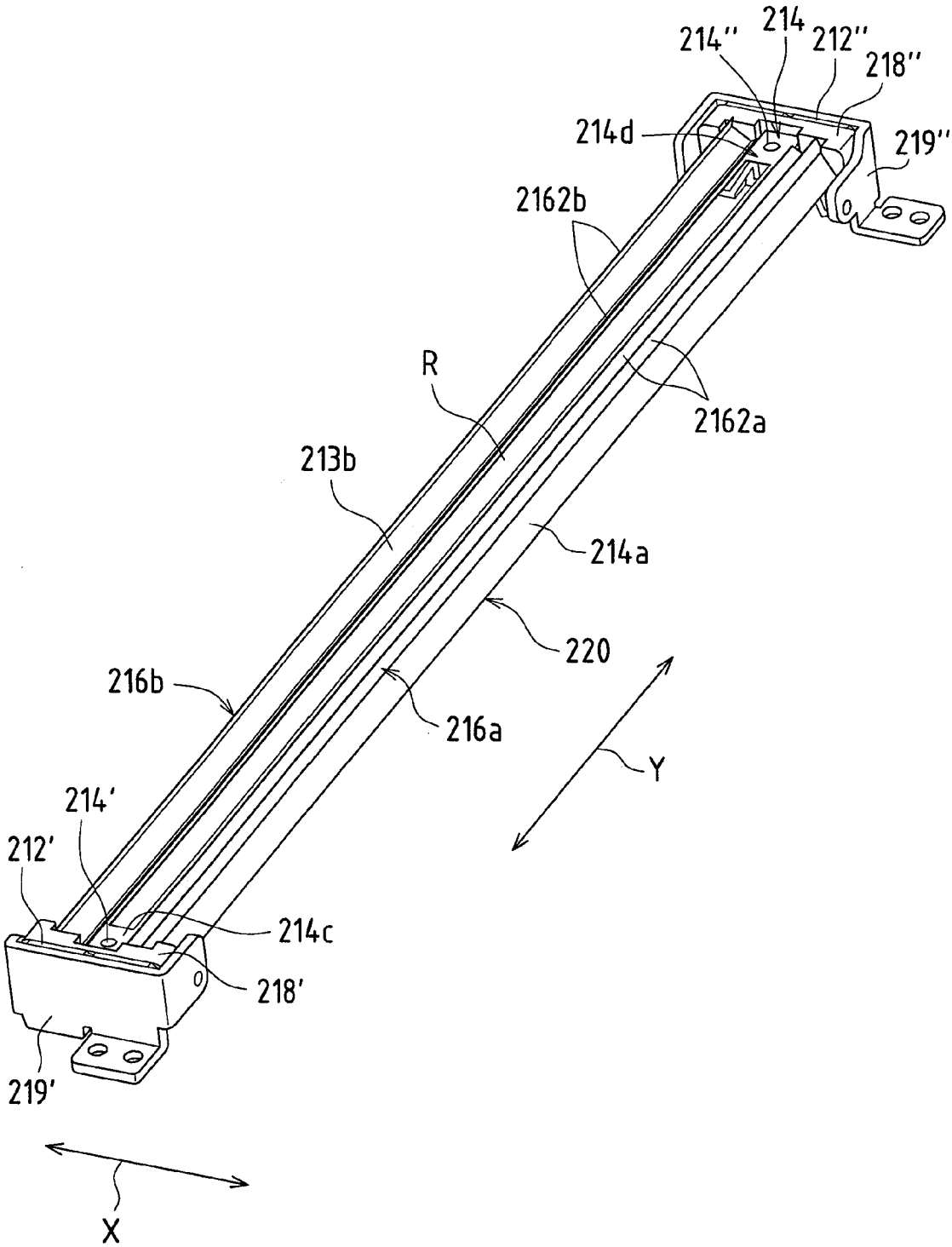
FIG. 5 is a schematic perspective view showing a light-source light-guiding member unit in the light-source unit.

FIG. 4 is a schematic perspective view showing a schematic configuration of the light-source unit 210 according to this embodiment. FIG. 5 is a schematic perspective view showing a light-source light-guiding member unit 220 in the light-source unit 210.

Figure 6A:
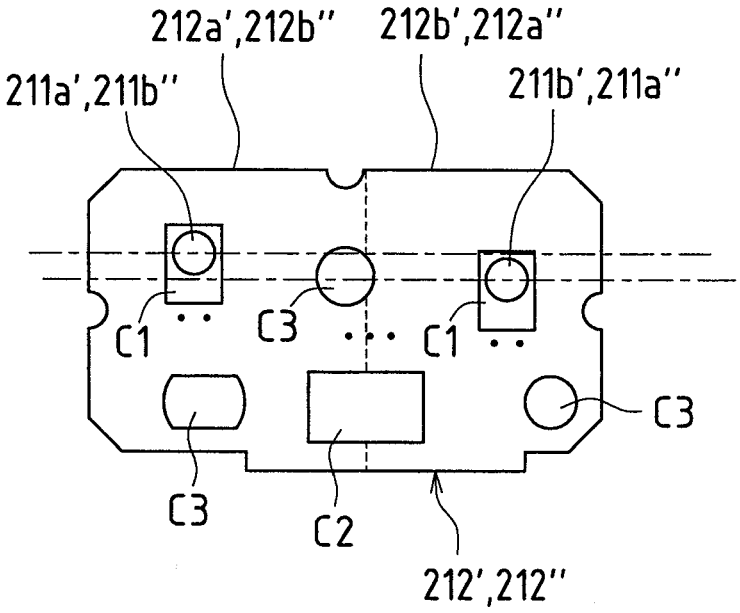
Figure 6B:
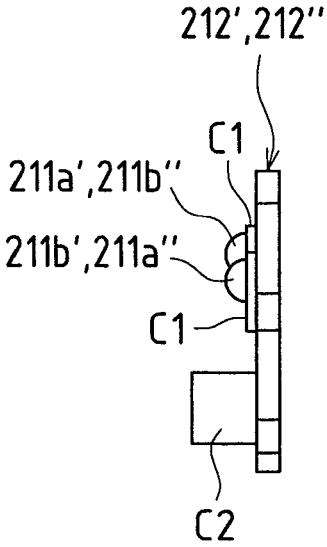

FIGS. 6A and 6B are schematic views showing a configuration of two light-source supports 212' and 212" in the light-source unit 210. FIG. 6A shows a front view of the light-source supports 212' and 212". FIG. 6B shows a side view of the light-source supports 212' and 212". Here, the two light-source supports 212' and 212" are members having the same configuration, and FIGS. 6A and 6B show one of the light-source supports. Furthermore, in FIGS. 6A and 6B, the symbol C1 denotes a pedestal of light-source portions 211*a*', 211*b*', 211*a*", and 211*b*", the symbol C2 denotes a connector terminal, and the symbol C3 denotes an attachment screw hole of the light-source supports 212' and 212".

Figure 7B:
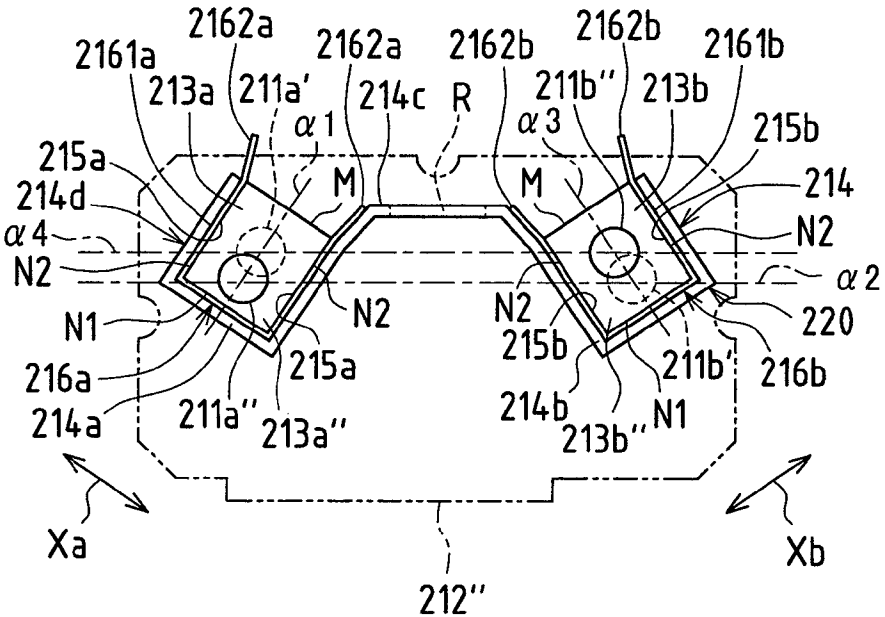
Figure 7A:
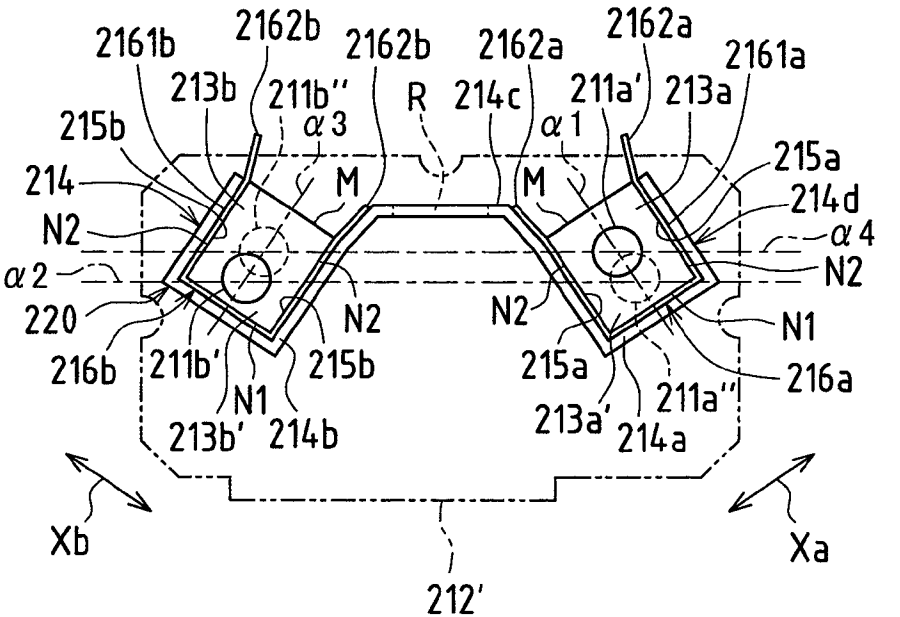

FIGS. 7A and 7B are schematic side views of the main portions of the light-source unit 210 viewed from the outside on both sides in the longitudinal direction. FIG. 7A shows a view from the outside on one side. FIG. 7B shows a view from the outside on the other side. Here, in FIGS. 7A and 7B, the pedestal C1, the connector terminal C2, and the attachment screw hole C3 are not shown.

Figure 8A:
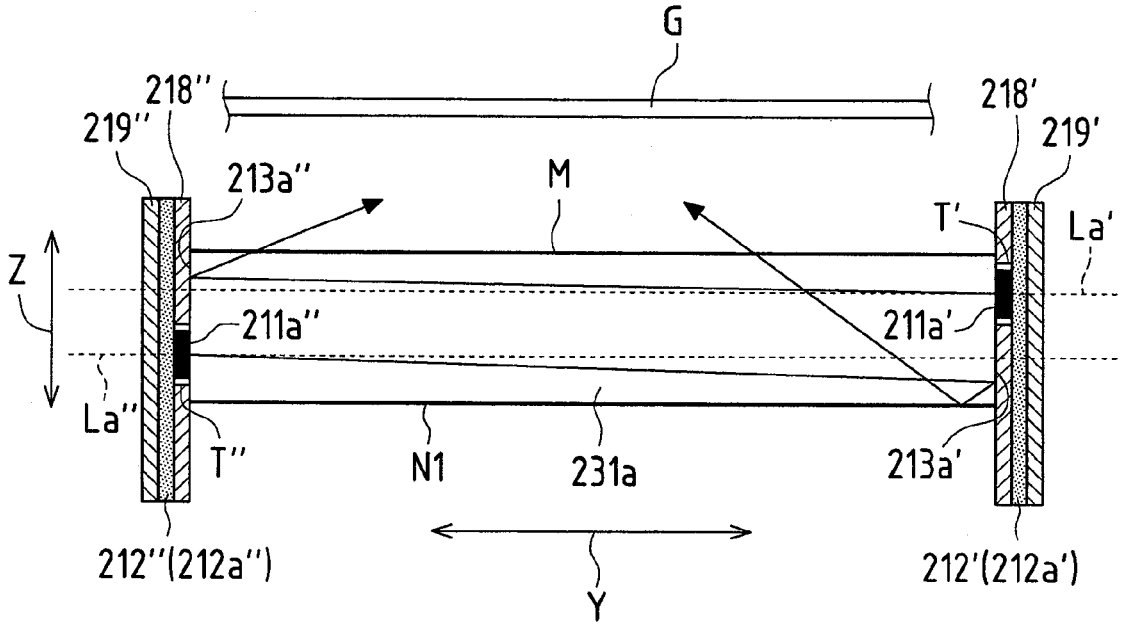
Figure 8B:
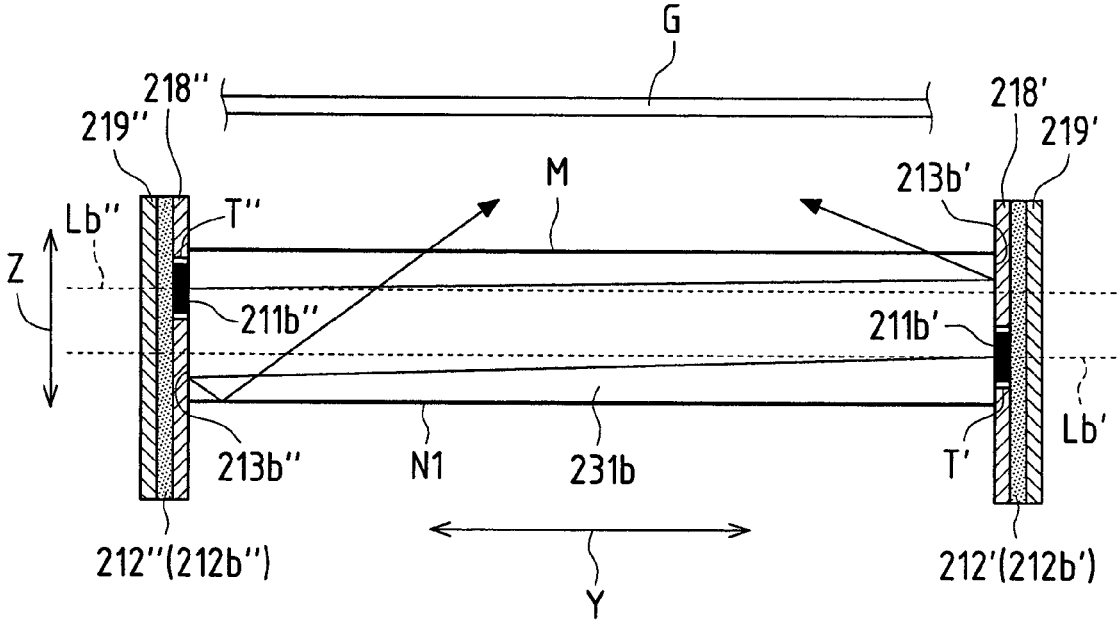

FIGS. 8A and 8B are schematic cross-sectional views illustrating a light-reflection state in the first and the second light-guiding members 213*a* and 213*b*. FIG. 8A shows a light-reflection state in which light from two first light-source portions 211*a*' and 211*a*" in which light-emitting faces oppose each other is guided from two end faces 213*a*' and 213*a*" in a longitudinal direction Y, and, thus, is irradiated from a light-discharging face M to the original G. FIG. 8B shows a light-reflection state in which light from two second light-source portions 211*b*' and 211*b*" in which light-emitting faces oppose each other is guided from two end faces 213*b*' and 213*b*" in the longitudinal direction Y, and, thus, is irradiated from the light-discharging face M to the original G. Here, in FIGS. 8A and 8B, a glass disposed between the original and the light-source portions is not shown.

The light-source unit 210 includes the two light-source supports 212' and 212", the first and the second light-guiding members 213*a* and 213*b*, a base member 214, and a first and a second main reflecting member (reflective film, in this example) 215*a* and 215*b*.

In this embodiment, the one light-source support 212', of the two light-source supports 212' and 212", is obtained by integrally forming a first light-source support 212*a*' on one side and a second light-source support 212*b*' on one side (see FIGS. 6A and 6B). The first light-source portion 211*a*' on one side that discharges light to the first light-guiding member 213*a* is set up on the first light-source support 212*a*' on one side. The second light-source portion 211*b*' on one side that discharges light to the second light-guiding member 213*b* is set up on the second light-source support 212*b*' on one side. Furthermore, the other light-source support 212", of the two light-source supports 212' and 212", is obtained by integrally forming a first light-source support 212*a*" on the other side and a second light-source support 212*b*" on the other side (see FIGS. 6A and 6B). The first light-source portion 211*a*" on the other side that discharges light to the first light-guiding member 213*a* is set up on the first light-source support 212*a*" on the other side. The second light-source portion 211*b*" on the other side that discharges light to the second light-guiding member 213*b* is set up on the second light-source support 212*b*" on the other side. Here, the light-source portions correspond to the members denoted by the reference numeral 211 in FIG. 2.

More specifically, each of the first and the second light-source portions 211*a*' and 211*b*' on one side and the first and the second light-source portions 211*a*" and 211*b*" on the other side is realized as an LED light-source portion including an LED light-emitting element.

Figure 10:
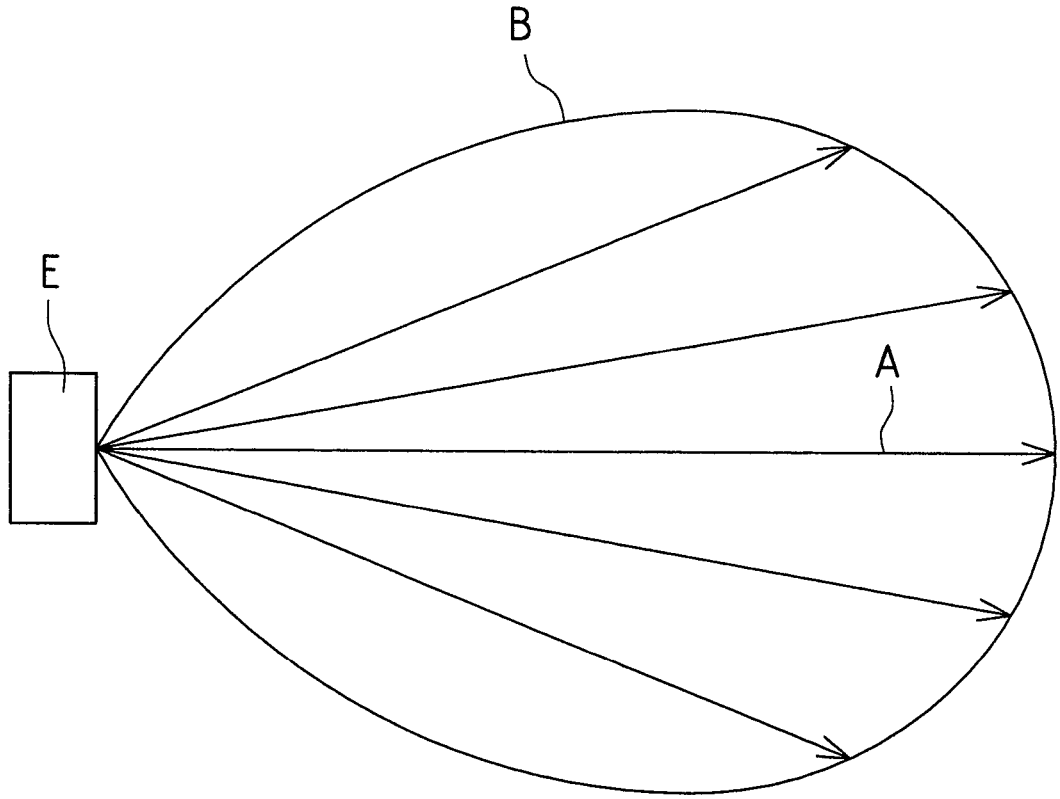
FIG. 10 is a view showing an example of the directional characteristics of a light-source having strong directional characteristics in a predetermined direction.

Accordingly, each of the light-source portions 211*a*', 211*b*', 211*a*", and 211*b*" is a light-source portion having strong directional characteristics in a predetermined direction A (see FIG. 10) along the longitudinal direction Y. The direction in which a light flux is most intense among light discharged from each of the light-source portions 211*a*', 211*b*', 211*a*", and 211*b*" is an optical axis.

Each of the first and the second light-guiding members 213*a* and 213*b* is made of a translucent material, and is a long member that extends in the main-scanning direction Y. The first and the second light-guiding members 213*a* and 213*b* are arranged side by side in the sub-scanning direction X along a light-irradiated face of the original G with a predetermined gap interposed therebetween such that their longitudinal directions Y match each other.

In the first light-guiding member 213*a*, light from the first light-source portion 211*a*' on one side is guided from the one end face 213*a*' in the longitudinal direction Y, and light from the first light-source portion 211*a*" on the other side is guided from the other end face 213*a*" in the longitudinal direction Y, and, thus, the light is irradiated from a light-discharging face (top face) M that extends in the longitudinal direction Y to the original G (see FIG. 8A). In the second light-guiding member 213*b*, light from the second light-source portion 211*b*' on one side is guided from the one end face 213*b*' in the longitudinal direction Y, and light from the second light-source portion 211*b*" on the other side is guided from the other end face 213*b*" in the longitudinal direction Y, and, thus, the light is irradiated from a light-discharging face (top face) M that extends in the longitudinal direction Y to the original G (see FIG. 8B).

More specifically, each of the first and the second light-guiding members 213*a* and 213*b* is in the shape of a rectangular solid. In this example, each of the first and the second light-guiding members 213*a* and 213*b* is made of acrylic resin. Furthermore, each of the faces (bottom faces) of the first and the second light-guiding members 213*a* and 213*b* positioned on the opposite side of the light-discharging faces M is referred to as a reflection face N1. The reflection face N1 in this example is formed in the shape of very small triangles (e.g., a saw) when viewed from width directions Xa and Xb along the light-discharging face M that is perpendicular to the longitudinal direction Y. Furthermore, in order to improve the amount of light toward the center in the longitudinal direction Y, the intervals between the tops of the peaks of the reflection face N1 formed in the shape of triangles gradually become smaller toward the center in the longitudinal direction Y.

As shown in FIGS. 4, 5, 7A, and 7B, the base member 214 includes a securing portion (a screw hole for securing with a screw SC, in this example) 214' on one side that secures the one light-source support 212' to the one end faces 213*a*' and 213*b*' in the longitudinal direction of the first and the second light-guiding members 213*a* and 213*b*, and a securing portion (a screw hole for securing with a screw SC, in this example) 214" on the other side that secures the other light-source support 212" to the other end faces 213*a*" and 213*b*" in the longitudinal direction of the first and the second light-guiding members 213*a* and 213*b*. In this manner, the first and the second light-source portions 211*a*' and 211*b*' on one side are arranged at the one end faces 213*a*' and 213*b*' in the longitudinal direction of the first and the second light-guiding members 213*a* and 213*b*, and the first and the second light-source portions 211*a*" and 211*b*" on the other side are arranged at the other end faces 213*a*" and 213*b*" in the longitudinal direction of the first and the second light-guiding members 213*a* and 213*b*.

The base member 214 further includes a first support portion 214*a* that supports the first light-guiding member 213*a*, a second support portion 214*b* that supports the second light-guiding member 213*b*, and a coupling portion 214*c* that couples the first support portion 214*a* and the second support portion 214*b*. A slit R through which the light reflected from the original G pass and that extending in the longitudinal direction Y is formed in the coupling portion 214*c* that is disposed between the first support portion 214*a* and the second support portion 214*b*. Here, the first support portion 214*a*, the second support portion 214*b*, and the coupling portion 214*c* in this example are configured as an integrally formed support plate 214*d*.

More specifically, each of the first and the second support portions 214*a* and 214*b* is formed in the shape of a U when viewed from a side in the longitudinal direction Y. That is to say, each of the first and the second support portions 214*a* and 214*b* includes a bottom plate that extends in the longitudinal direction Y, and both side plates that extend toward the original G perpendicularly or substantially perpendicularly from both end portions in the width direction Xa or Xb along the light-discharging face M that is perpendicular to the longitudinal direction Y of the bottom plate. The first and the second support portions 214*a* and 214*b* are arranged side by side in the direction X along the light-irradiated face of the original G that is perpendicular to the longitudinal direction Y with a predetermined gap interposed therebetween such that their longitudinal directions Y match each other. Furthermore, the U-shaped open end of the first support portion 214*a* closer to the second support portion 214*b* and the U-shaped open end of the second support portion 214*b* closer to the first support portion 214*a* are coupled by the coupling portion 214*c*. The securing portion 214' on one side is disposed at one end portion of both end portions in the longitudinal direction Y of the coupling portion 214*c*, and the securing portion 214" on the other side is disposed at the other end portion. Here, the first and the second light-guiding members 213*a* and 213*b* are arranged such that light discharged from one of the light-discharging faces M and light discharged from the other light-discharging faces M intersect each other on the light-irradiated face of the original G (such that the incident angles at which light is incident on the light-irradiated face of the original G are the same when viewed from a side in the longitudinal direction Y, in this example). Accordingly, in this example, the first and the second support portions 214*a* and 214*b* are formed in gradually spreading shapes that spread on the side of the U-shaped base end that is on the opposite side of the U-shaped open end when viewed from a side in the longitudinal direction Y.

The first main reflecting members 215*a* mainly reflect light that passes through the first light-guiding member 213*a*, at side faces N2 on both sides in the width direction Xa along the light-discharging face M that is perpendicular to the longitudinal direction Y of the light-guiding member 213*a*, and the second main reflecting members 215*b* mainly reflect light that passes through the second light-guiding member 213*b*, at the side faces N2 on both sides in the width direction Xb of the light-guiding member 213*b* (see FIGS. 7A and 7B).

More specifically, the first main reflecting members 215*a* are arranged on faces of the first light-guiding member 213*a* other than the two end faces 213*a*' and 213*a*" and the light-discharging face M. The second main reflecting members 215*b* are arranged on faces of the second light-guiding member 213*b* other than the two end faces 213*b*' and 213*b*" and the light-discharging face M. Each of the first and the second main reflecting members 215*a* and 215*b* is made of a reflective film having a high reflectance ratio (e.g., Vikuiti (registered trademark) of the DESR-M series having a high reflectance ratio of 98% or more (manufactured by Sumitomo 3M Limited)), and is disposed at least on the two side faces N2, among the reflection face N1 and the two side faces N2 of the first and the second light-guiding members 213*a* and 213*b*.

In this embodiment, the base member 214 further includes a first and a second holding member 216*a* and 216*b* that respectively hold the first and the second light-guiding members 213*a* and 213*b*.

The first holding member 216*a* includes a first holding portion 2161*a* and first inclined portions 2162*a*. The first holding portion 2161*a* detachably holds the first light-guiding member 213*a*. The first inclined portions 2162*a* reflect light discharged from the light-discharging face M of the first light-guiding member 213*a*, and extend from the front ends of the first holding portion 2161*a* on the side of the light-discharging face M so as to diagonally spread away from the first light-guiding member 213*a*. Furthermore, the second holding member 216*b* includes a second holding portion 2161*b* and second inclined portions 2162*b*. The second holding portion 2161*b* detachably holds the second light-guiding member 213*b*. The second inclined portions 2162*b* reflect light discharged from the light-discharging face M of the second light-guiding member 213*b*, and extend from the front ends of the second holding portion 2161*b* on the side of the light-discharging face M so as to diagonally spread away from the second light-guiding member 213*b*.

In this embodiment, each of the first and the second holding portions 2161*a* and 2161*b* is formed in the shape of a U when viewed from a side in the longitudinal direction Y. That is to say, each of the first and the second holding portions 2161*a* and 2161*b* includes a bottom plate that extends in the longitudinal direction Y, and both side plates that extend toward the original G perpendicularly or substantially perpendicularly from both end portions in the width direction Xa or Xb along the light-discharging face M that is perpendicular to the longitudinal direction Y of the bottom plate. The first and the second inclined portions 2162*a* and 2162*b* are respectively formed in gradually spreading shapes that diagonally spread away from the first and the second light-guiding members 213*a* and 213*b* when viewed from a side in the longitudinal direction Y.

The first and the second light-guiding members 213*a* and 213*b* are respectively detachably fitted to the U-shaped inner faces of the first and the second holding portions 2161*a* and 2161*b*. Accordingly, the first and the second holding portions 2161*a* and 2161*b* can reliably hold the first and the second light-guiding members 213*a* and 213*b* in close contact with the inner faces of the first and the second holding portions 2161*a* and 2161*b*. Furthermore, the first and the second holding members 216*a* and 216*b* are respectively detachably fitted to the first and the second support portions 214*a* and 214*b*. Accordingly, in the state where the first and the second holding members 216*a* and 216*b* are detached from the first and the second support portions 214*a* and 214*b*, the first and the second light-guiding members 213*a* and 213*b* can be respectively detached from the first and the second holding portions 2161*a* and 2161*b*, and, thus, the exchangeability of the first and the second light-guiding members 213*a* and 213*b* can be improved accordingly. Furthermore, the first and the second main reflecting members 215*a* and 215*b* are respectively supported by the first and the second holding portions 2161*a* and 2161*b*. Here, the first and the second holding portions 2161*a* and 2161*b* themselves respectively may function as the first and the second main reflecting members 215*a* and 215*b*.

For example, each of the first and the second holding portions 2161*a* and 2161*b* and the first and the second inclined portions 2162*a* and 2162*b* can be made of a metal material, such as stainless steel (SUS). In this case, the first and the second holding portions 2161*a* and 2161*b* also can respectively function as the first and the second main reflecting members 215*a* and 215*b*. Accordingly, the inner faces of the first and the second holding portions 2161*a* and 2161*b* can respectively function as the reflection faces that reflect light in the first and the second light-guiding members 213*a* and 213*b*. Here, the first and the second light-guiding members 213*a* and 213*b*, the first and the second holding members 216*a* and 216*b*, and the support plate 214*d* form the light-source light-guiding member unit 220. Furthermore, the support plate 214*d* and the first and the second holding members 216*a* and 216*b* may be integrally formed.

In this example, a reflective film is attached as the first main reflecting members 215*a* to the inner faces of the first holding portion 2161*a* and the first inclined portions 2162*a* forming the first holding member 216*a*. Furthermore, a reflective film is attached as the second main reflecting members 215*b* to the inner faces of the second holding portion 2161*b* and the second inclined portions 2162*b* forming the second holding member 216*b*.

The light-source unit 210 further includes the first mirror 230 (see FIG. 2). The first mirror 230 is supported by a supporting member (not shown) such that light reflected by the light-irradiated face of the original G is guided via the slit R that is disposed in the coupling portion 214*c* in the base member 214, to the second mirror 203*a* of the mirror unit 203.

Then, as shown in FIGS. 8A and 8B, the first light-source portion 211*a*' on one side and the first light-source portion 211*a*" on the other side are respectively arranged on the one light-source support 212' and on the other light-source support 212" such that the position of an optical axis La' of the first light-source portion 211*a*' on one side and the position of an optical axis La" of the first light-source portion 211*a*" on the other side do not match each other (that is to say, such that at least one of the optical axes La' and La" of the first light-source portions 211*a*' and 211*a*" on one side and the other side is not reflected at the position of the optical axis of the light-emitting face of the other first light-source portion) (see FIG. 8A). Furthermore, the second light-source portion 211*b*' on one side and the second light-source portion 211*b*" on the other side are respectively arranged on the one light-source support 212' and on the other light-source support 212" such that the position of an optical axis Lb' of the second light-source portion 211*b*' on one side and the position of an optical axis Lb" of the second light-source portion 211*b*" on the other side do not match each other (that is to say, such that at least one of the optical axes Lb' and Lb" of the second light-source portions 211*b*' and 211*b*" on one side and the other side is not reflected at the position of the optical axis of the light-emitting face of the other second light-source portion) (see FIG. 8B).

More specifically, as shown in FIG. 8A, the first light-source portions 211*a*' and 211*a*" are respectively arranged on the one light-source support 212' and on the other light-source support 212" such that the optical axis La' of the first light-source portion 211*a*' on one side and the optical axis La" of the first light-source portion 211*a*" on the other side are parallel to each other, and the positions of the optical axes La' and La" differ from each other in a direction that is perpendicular to the light-irradiated face of the original G (the arrow Z direction in FIG. 8A). Here, the first light-source portions

211*a*' and 211*a*" in this example are respectively arranged on the one light-source support 212' and on the other light-source support 212" such that the optical axis La' of the first light-source portion 211*a*' on one side and the optical axis La" of the first light-source portion 211*a*" on the other side are parallel to each other, and the positions of the optical axes La' and La" differ from each other also in a direction that is parallel to the light-irradiated face of the original G and in the direction X that is perpendicular to the longitudinal direction Y of the first light-guiding member 213*a*.

Furthermore, as shown in FIG. 8B, the second light-source portions 211*b*' and 211*b*" are respectively arranged on the one light-source support 212' and on the other light-source support 212" such that the optical axis Lb' of the second light-source portion 211*b*' on one side and the optical axis Lb" of the second light-source portion 211*b*" on the other side are parallel to each other, and the positions of the optical axes Lb' and Lb" differ from each other in the direction Z that is perpendicular to the light-irradiated face of the original G. Here, the second light-source portions 211*b*' and 211*b*" in this example are respectively arranged on the one light-source support 212' and on the other light-source support 212" such that the optical axis Lb' of the second light-source portion 211*b*' on one side and the optical axis Lb" of the second light-source portion 211*b*" on the other side are parallel to each other, and the positions of the optical axes Lb' and Lb" differ from each other also in a direction that is parallel to the light-irradiated face of the original G and in the direction X that is perpendicular to the longitudinal direction Y of the second light-guiding member 213*b*.

In this embodiment, the light-reflectance ratios of reflection faces that reflect light at the first and the second light-source portions 211*a*' and 211*b*' on one side and at the first and the second light-source portions 211*a*" and 211*b*" on the other side are lower than those of the portions other than the light-source portions.

In the light-source unit 210 described above, the first light-source portion 211*a*' on one side and the first light-source portion 211*a*" on the other side are respectively arranged on the one light-source support 212' and on the other light-source support 212" such that the position of the optical axis La' of the first light-source portion 211*a*' on one side and the position of the optical axis La" of the first light-source portion 211*a*" on the other side differ from each other. In this example, the optical axis La' of the first light-source portion 211*a*' on one side is positioned so as not to be reflected by the first light-source portion 211*a*" on the other side. Accordingly, the optical axis La' can be reflected by a reflection face of the first light-guiding member 213*a* other than the first light-source portion 211*a*" on the other side, at the other end face 213*a*" in the longitudinal direction Y. Also, the optical axis La" of the first light-source portion 211*a*" on the other side is positioned so as not to be reflected by the first light-source portion 211*a*' on one side. Accordingly, the optical axis La" can be reflected by a reflection face of the first light-guiding member 213*a* other than the first light-source portion 211*a*' on one side, at the one end face 213*a*' in the longitudinal direction Y.

Accordingly, in particular, it is possible to improve the reflection efficiency when the optical axes La' and La" that pass from the first light-source portion 211*a*' on one side and the first light-source portion 211*a*" on the other side respectively via the one end face 213*a*' and the other end face 213*a*" in the longitudinal direction Y of the first light-guiding member 213*a* and through the light-guiding member 213*a* are reflected by a reflection face at the other end face 213*a*" and a reflection face at the one end face 213*a*' in the longitudinal direction Y of the light-guiding member 213*a*.

Furthermore, as in the case of the above-described configuration, the second light-source portion 211*b*' on one side and the second light-source portion 211*b*" on the other side are respectively arranged on the one light-source support 212' and on the other light-source support 212" such that the position of the optical axis Lb' of the second light-source portion 211*b*' on one side and the position of the optical axis Lb" of the second light-source portion 211*b*" on the other side differ from each other. Accordingly, the optical axis Lb' of the second light-source portion 211*b*' on one side is not reflected by the second light-source portion 211*b*" on the other side, but can be reflected by a reflection face of the second light-guiding member 213*b* other than the second light-source portion 211*b*" on the other side, at the other end face 213*b*" in the longitudinal direction Y, and the optical axis Lb" of the second light-source portion 211*b*" on the other side is not reflected by the second light-source portion 211*b*' on one side, but can be reflected by a reflection face of the second light-guiding member 213*b* other than the second light-source portion 211*b*' on one side, at the one end face 213*b*' in the longitudinal direction Y.

Accordingly, in particular, it is possible to improve the reflection efficiency when the optical axes Lb' and Lb" that pass from the second light-source portion 211*b*' on one side and the second light-source portion 211*b*" on the other side respectively via the end face 213*b*' on one side and the end face 213*b*" on the other side in the longitudinal direction Y of the second light-guiding member 213*b* and through the light-guiding member 213*b* are reflected by a reflection face at the other end face 213*b*" and a reflection face at the one end face 213*b*' in the longitudinal direction Y of the light-guiding member 213*b*.

In this manner, according to the light-source unit 210, it is possible to suppress the reflective loss occurring when the optical axes La' and Lb' of the first and the second light-source portions 211*a*' and 211*b*' on one side and the optical axes La" and Lb" of the first and the second light-source portions 211*a*" and 211*b*" on the other side are reflected in the first and the second light-guiding members 213*a* and 213*b*, and it is possible to accordingly increase the amount of light that is irradiated from the light-discharging face M to the light-irradiated face of the original G.

Here, at least one of the first light-source portions 211*a*' and 211*a*" or at least one of the second light-source portions 211*b*' and 211*b*" may be configured as a light-source group including two or more light-sources (e.g., LED elements).

Figure 9A:
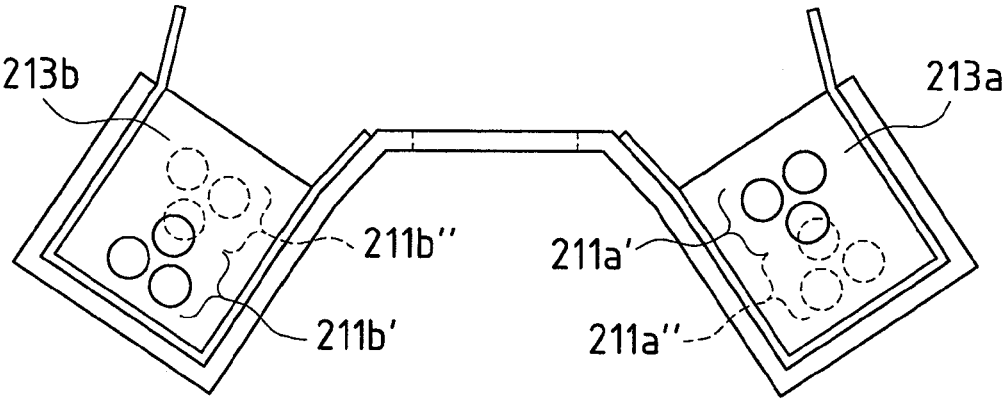
Figure 9B:
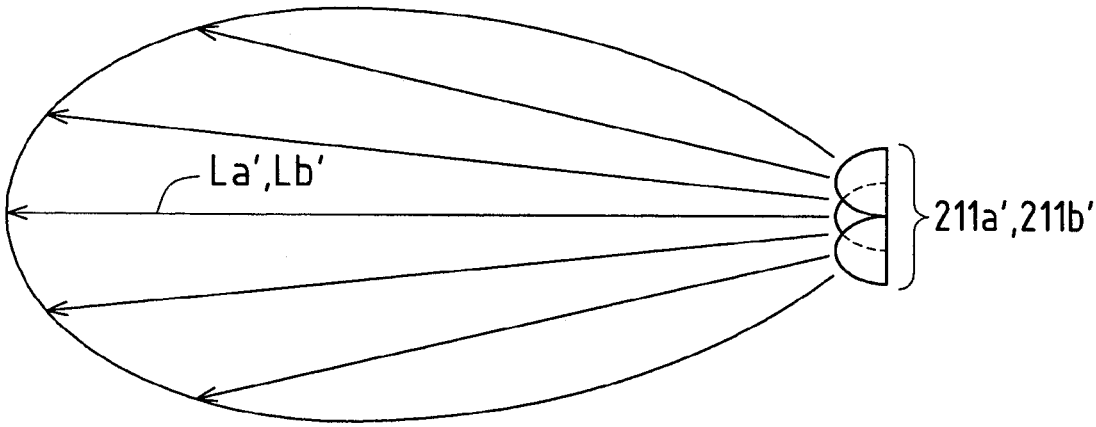
Figure 9C:
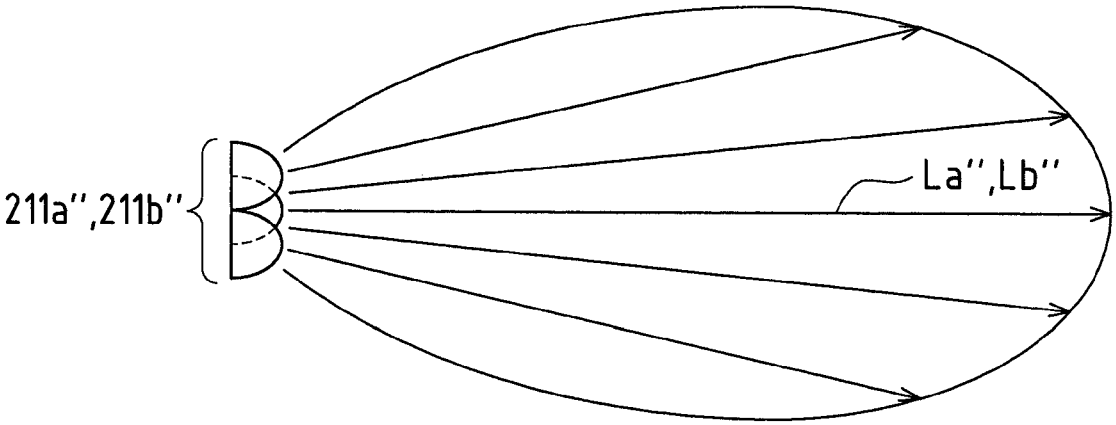

FIGS. 9A to 9C are views showing an example of both of the first light-source portions 211*a*' and 211*a*" and both of the second light-source portions 211*b*' and 211*b*" are realized as light-source groups including two or more LED elements. FIG. 9A shows a schematic side view of the main portions of the light-source unit 210 viewed from the outside on one side in the longitudinal direction Y. FIG. 9B shows an example of the directional characteristics of the light-source groups 211*a*' and 211*b*' on one side including two or more LED elements. FIG. 9C shows an example of the directional characteristics of the light-source groups 211*a*" and 211*b*" on the other side including two or more LED elements.

As shown in FIG. 9A, the first light-source groups 211*a*' and 211*a*" are arranged at both end faces in the longitudinal direction Y of the first light-guiding member 213*a*, and the second light-source groups 211*b*' and 211*b*" are arranged at both end faces in the longitudinal direction Y of the second light-guiding member 213*b*.

In this configuration, as shown in FIG. 9B, directions in which a light flux is most intense from amongst the entire light discharged from two or more (three, in the example shown in FIG. 9B) LED elements in the first and the second light-source groups 211*a*' and 211*b*' on one side may be referred to as the optical axes La' and Lb'. Furthermore, as shown in FIG. 9C, directions in which a light flux is most intense from amongst the entire light discharged from two or more (three, in the example shown in FIG. 9C) LED elements in the first and the second light-source groups 211*a*" and 211*b*" on the other side may be referred to as the optical axes La" and Lb".

In this embodiment, as shown in FIGS. 4, 5, and 8A and 8B, a reflecting member 218' on one side is interposed between the one light-source support 212' and the first and the second light-guiding members 213*a* and 213*b*, and a reflecting member 218" on the other side is interposed between the other light-source support 212" and the first and the second light-guiding members 213*a* and 213*b*.

More specifically, the reflecting member 218' on one side to which one end portion in the longitudinal direction Y of the support plate 214*d* is attached is disposed on the securing portion 214' on one side, and the one light-source support 212' is set up on the outer side of the reflecting member 218' on one side. Furthermore, the reflecting member 218" on the other side to which the other end portion in the longitudinal direction Y of the support plate 214*d* is attached is disposed on the securing portion 214" on the other side, and the other light-source support 212" is set up on the outer side of the reflecting member 218" on the other side.

In this embodiment, the light-source unit 210 further includes a heat-radiating member 219' on one side and a heat-radiating member 219" on the other side. The heat-radiating member 219' on one side is disposed in close contact with the reflecting member 218' on one side so as to surround the reflecting member 218' on one side and the one light-source support 212'. The heat-radiating member 219" on the other side is disposed in close contact with the reflecting member 218" on the other side so as to surround the reflecting member 218" on the other side and the other light-source support 212".

More specifically, the heat-radiating member 219' on one side is attached to a frame 210*x* of the light-source unit 210 so as to be in close contact with both side faces in the width direction of the reflecting member 218' on one side and surround the back face of the one light-source support 212'. Furthermore, the heat-radiating member 219" on the other side is attached to the frame 210*x* of the light-source unit 210 so as to be in close contact with both side faces in the width direction of the reflecting member 218" on the other side and surround the back face of the other light-source support 212".

Each of the reflecting members 218' and 218" and the heat-radiating members 219' and 219" in this example is made of a metal material, such as aluminum. Here, the reflecting member 218' on one side has a through-hole T' for passing light from the first and the second light-source portions 211*a*' and 211*b*' on one side, and the reflecting member 218" on the other side has a through-hole T' for passing light from the first and the second light-source portions 211*a*" and 211*b*" on the other side.

According to this configuration, the reflection face of the first and the second light-guiding members 213*a* and 213*b* at the one end faces 213*a*' and 213*b*' in the longitudinal direction Y can be a reflection face realized as the reflecting member 218' on one side. Accordingly, light that is introduced from the first and the second light-source portions 211*a*" and 211*b*" on the other side respectively via the other end faces 213*a*" and 213*b*" in the longitudinal direction Y of the first and the second light-guiding members 213*a* and 213*b* into the light-guiding members 213*a* and 213*b* (in particular, the optical axes La" and Lb") is reflected by the reflection face of the reflecting member 218' on one side, and, thus, the reflection efficiency can be further improved. Furthermore, the reflection face of the first and the second light-guiding members 213*a* and 213*b* at the other end faces 213*a*" and 213*b*" in the longitudinal direction Y can be a reflection face realized as the reflecting member 218" on the other side. Accordingly, light that is introduced from the first and the second light-source portions 211*a*' and 211*b*' on one side respectively via the one end faces 213*a*' and 213*b*' in the longitudinal direction Y of the first and the second light-guiding members 213*a* and 213*b* into the light-guiding members 213*a* and 213*b* (in particular, the optical axes La' and Lb') is reflected by the reflection face of the reflecting member 218" on the other side, and, thus, the reflection efficiency can be further improved. Accordingly, it is possible to further suppress the reflective loss occurring when the optical axes La' and Lb' of the first and the second light-source portions 211*a*' and 211*b*' on one side and the optical axes La" and Lb" of the first and the second light-source portions 211*a*" and 211*b*" on the other side are reflected in the light-guiding members 213*a* and 213*b*, and it is possible to accordingly increase the amount of light that is irradiated from the light-discharging face M to the light-irradiated face of the original G.

Moreover, in this configuration, each of the reflecting member 218' on one side and the reflecting member 218" on the other side is made of a metal material having excellent thermal conductivity, and, thus, heat generated by the first and the second light-source portions 211*a*' and 211*b*' on one side and the first and the second light-source portions 211*a*" and 211*b*" on the other side can be effectively radiated by the reflecting members 218' and 218".

Moreover, in this embodiment, the heat-radiating member 219' on one side that is disposed in close contact with the reflecting member 218' on one side surrounds the reflecting member 218' on one side and the one light-source support 212', and, thus, heat generated by the first and the second light-source portions 211*a*' and 211*b*' on one side can be radiated directly and indirectly via the reflecting member 218' on one side. Furthermore, the heat-radiating member 219" on the other side that is disposed in close contact with the reflecting member 218" on the other side surrounds the reflecting member 218" on the other side and the other light-source support 212", and, thus, heat generated by the first and the second light-source portions 211*a*" and 211*b*" on the other side can be radiated directly and indirectly via the reflecting member 218" on the other side. Here, each of the reflecting members 218' and 218" may be made of a reflective film and a member having excellent thermal conductivity, such as a metal member, that supports the reflective film.

Here, when two light-guiding members are applied, and light-source supports are arranged at both end portions in the longitudinal direction thereof, four light-source supports are necessary, and as many as four supports have to be attached. Thus, the structure of the attachment members may be complicated. However, in this embodiment, the first and the second light-source supports 212*a*' and 212*b*' are integrally formed as the one light-source support 212', and the first and the second light-source supports 212*a*" and 212*b*" on the other side are integrally formed as the other light-source support 212". Accordingly, the cost of the constituent components can be reduced, and the number of the constituent components can be reduced. Also, the assembly operation can be improved.

Furthermore, in this embodiment, as shown in FIG. 8A, the first light-source portion 211*a*' on one side is closer to the original G than the first light-source portion 211*a*" on the other side, and, as shown in FIG. 8B, the second light-source portion 211*b*" on the other side is closer to the original G than the second light-source portion 211*b*' on one side. Furthermore, as shown in FIG. 7A, the second light-source portion 211*b*' on one side is positioned farther from the original G than the first light-source portion 211*a*' on one side, and, as shown in FIG. 7B, the first light-source portion 211*a*" on the other side is positioned farther from the original G than the second light-source portion 211*b*" on the other side.

In this configuration, as shown in FIG. 8A, the first light-source portion 211*a*' on one side is closer to the original G than the first light-source portion 211*a*" on the other side, and, thus, one side in the longitudinal direction Y of the original G is brighter than the other side. In this state, as shown in FIG. 8B, the second light-source portion 211*b*" on the other side is closer to the original G than the second light-source portion 211*b*' on one side, and, thus, light can be irradiated to the light-irradiated face of the original G in a state where the amount of light in the longitudinal direction Y is made uniform. That is to say, since the second light-source portion 211*b*' on one side is farther from the original G than the first light-source portion 211*a*' on one side as shown in FIG. 7A, the amount of light on one side in the longitudinal direction Y of the original G can be made uniform, and, since the first light-source portion 211*a*" on the other side is farther from the original G than the second light-source portion 211*b*" on the other side as shown in FIG. 7B, the amount of light on the other side in the longitudinal direction Y of the original G can be made uniform.

Here, each of the light-source portions 211*a*', 211*b*', 211*a*", and 211*b*" can be disposed at the optimum position according to the arranged state of the light-guiding members 213*a* and 213*b* and the shape (e.g., a square or a rectangle) of the light-guiding members 213*a* and 213*b* when viewed from a side in the longitudinal direction Y. For example, as light is closer to the main reflecting members 215*a* and 215*b* that are arranged on the two side faces N2 in the width direction of the light-guiding members 213*a* and 213*b*, the light can be effectively reflected by the main reflecting members 215*a* and 215*b*. That is to say, the optical axes La' Lb', La", and Lb" of the light-source portions 211*a*', 211*b*', 211*a*", and 211*b*" are incident on the light-guiding members 213*a* and 213*b*, reflected by the reflection face N1 on the bottom portion and the side faces N2, and discharged from the light-discharging face M, and when light spread from the optical axis at that time is close to the side faces N2, the amount of light that is irradiated to the original G tends to be increased.

Figure 11B:
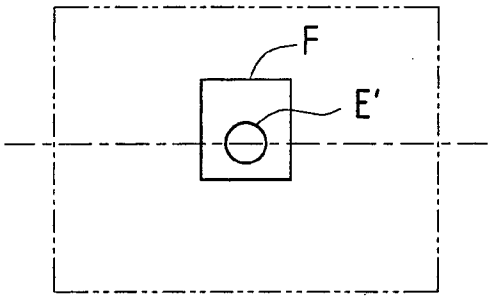
FIG.11B Prior Art
Figure 11A:
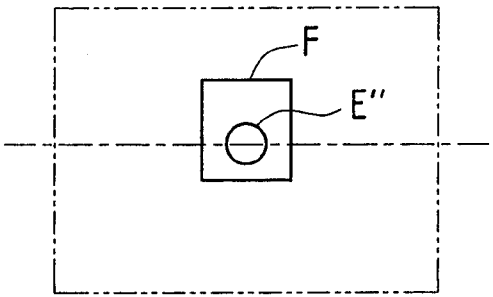
FIG.11A Prior Art
Figure 11C:
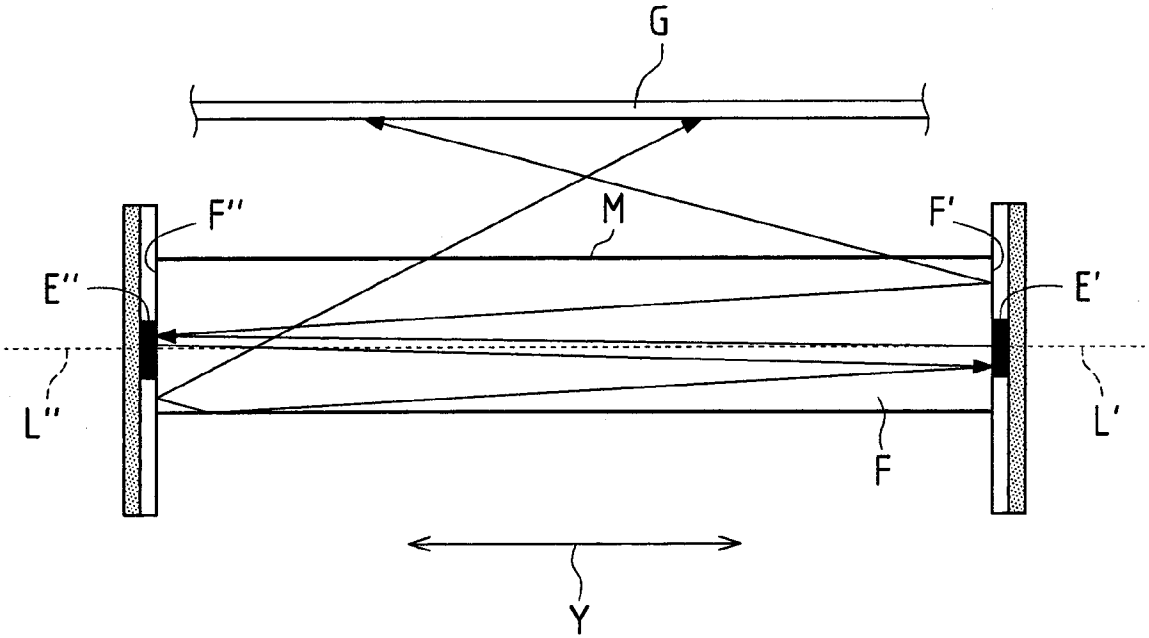
FIG.11C Prior Art

Here, in a conventional configuration, as described in FIGS. 11A to 11C, when light from one or the other light-source is reflected by the other or one light-source, reflective loss occurs, and the amount of light that is irradiated to the original is reduced. However, the light-sources are arranged such that optical axes thereof are coaxially positioned, and, thus, one light-source support and the other light-source support can be easily used to substitute each other in use.

Regarding this point, in this embodiment, as shown in FIGS. 7A and 7B, the first and the second light-source portions 211*a*' and 211*b*' on one side are arranged so as to be point symmetric with the integrally formed one light-source support 212'. Also, the first and the second light-source portions 211*a*" and 211*b*" on the other side are arranged so as to be point symmetric with the integrally formed the other light-source support 212", as in the case of the first and the second light-source portions 211*a*' and 211*b*' on one side.

More specifically, when the first and the second light-guiding members 213*a* and 213*b* are viewed from the longitudinal direction Y, the shape defined by four virtual lines α1, α2, α3, α4 is substantially rectangular or of isosceles trapezoid (an isosceles trapezoid, in this example). The first virtual line α1 connects centers of projection images of the first light-source portions 211*a*' and 211*a*" on one side and on the other side. The second virtual line α2 connects centers of projection images of the first light-source portion 211*a*" on the other side and the second light-source portion 211*b*' on one side. The third virtual line α3 connects centers of projection images of the second light-source portions 211*b*' and 211*b*" on one side and on the other side, and the fourth virtual line α4 connects centers of projection images of the second light-source portion 211*b*" on the other side and the first light-source portion 211*a*' on one side.

In this configuration, the first and the second light-source portions 211*a*' and 211*b*' on one side that are set up on the integrally formed one light-source support 212' and the first and the second light-source portions 211*a*" and 211*b*" on the other side that are set up on the integrally formed the other light-source support 212" are arranged such that the shape that is defined by the first to the fourth virtual lines α1 to α4 is a rectangle or an isosceles trapezoid, and, thus, the one light-source support 212' on which the first and the second light-source portions 211*a*' and 211*b*' on one side are set up can be used on the other side, and the other light-source support 212" on which the first and the second light-source portions 211*a*" and 211*b*" on the other side are set up can be used on one side. That is to say, the one light-source support 212' and the other light-source support 212" can be used to substitute each other in use.

The present invention may be embodied in various other forms without departing from the spirit or essential characteristics thereof. The examples (embodiments) disclosed above are to be considered in all respects as illustrative and not limiting. The scope of the invention is indicated by the appended claims rather than by the foregoing description, and all modifications or changes that come within the range of equivalency of the claims are intended to be embraced therein.

What is claimed is:

1. An illuminating device that illuminates an object, comprising:

a light-source portion on one side;

a light-source portion on the other side; and a long translucent light-guiding member having a light-discharging face long in a longitudinal direction thereof, and guiding light derived from the one light-source portion from one end face in the longitudinal direction, and light derived from the other light-source portion from the other end face in the longitudinal direction so that the guided light is irradiated to an object through the long light-discharging face;

wherein one and the other light-source portions are arranged such that the positions of optical axes thereof differ from each other in a direction that is parallel to a light-irradiated face of the object and in a direction that is perpendicular to the longitudinal direction of the light-guiding member.

2. The illuminating device according to claim 1, wherein the one and the other light-source portions are arranged such that the positions of the optical axes thereof differ from each other in a direction that is perpendicular to a light-irradiated face of the object.

3. The illuminating device according to claim 1, wherein at least one of the light-source portion on one side and the light-source portion on the other sode is configured as a light-source group including at least two light-sources.

4. The illuminating device according to claim 1, further comprising a main reflecting member that reflects light in the light-guiding member.

5. The illuminating device according to claim 4, further comprising:

one light-source support on which the one light-source portion is set up;

the other light-source support on which the other light-source portion is set up; and a base member;

wherein the base member supports the one light-source support at the one end face in the longitudinal direction of the light-guiding member, and the other light-source support at the other end face in the longitudinal direction of the light-guiding member, and the one and the other light-source portions are respectively set up on the one and the other light-source supports so that the positions of the optical axes of the one and the other light-source portions differ from each other.

6. The illuminating device according to claim 5, wherein a reflecting member on one side is interposed between the one light-source support and the light-guiding member, and a reflecting member on the other side is interposed between the other light-source support and the light-guiding member.

7. The illuminating device according to claim 5, wherein:

the one light-source portion includes a first light-source portion and a second light-source portion on the one side, which are set up on the one light-source support;

the other light-source portion includes a first light-source portion and a second light-source portion on the other side, which are set up on the other light-source support;

the light-guiding member includes a first light-guiding member and a second light-guiding member that are arranged side by side in a direction that is perpendicular to the longitudinal direction such that these end faces in the longitudinal direction thereof are aligned with each other;

the base member has a slit through which the light reflected from the object pass, between the first and the second light-guiding members, the slit extending in the longitudinal direction, and the base member supports the one light-source support at the one end face in the longitudinal direction of the first and the second light-guiding members, and the other light-source support at the other end face in the longitudinal direction of the first and the second light-guiding members;

the main reflecting member includes a first main reflecting member that reflects light in the first light-guiding member and a second main reflecting member that reflects light in the second light-guiding member;

the first light-source portions on the one side and on the other side are respectively arranged on the one and the other light-source supports such that positions of the optical axes of the first light-source portions respectively differ from each other; and the second light-source portions on the one side and on the other side are respectively arranged on the one and the other light-source supports such that positions of the optical axes of the second light-source portions respectively differ from each other.

8. The illuminating device according to claim 7, wherein, when the first light-source portion on one side is closer to the object than the first light-source portion on the other side, the second light-source portion on the other side is closer to the object than the second light-source portion on one side, the second light-source portion on one side is positioned farther from the object than the first light-source portion on one side, and the first light-source portion on the other side is positioned farther from the object than the second light-source portion on the other side, or wherein, when the first light-source portion on one side is farther from the object than the first light-source portion on the other side, the second light-source portion on the other side is farther from the object than the second light-source portion on one side, the second light-source portion on one side is positioned closer to the object than the first light-source portion on one side, and the first light-source portion on the other side is positioned closer to the object than the second light-source portion on the other side.

9. The illuminating device according to claim 8, wherein, when viewed from the longitudinal direction of the first and the second light-guiding members, a shape defined by four virtual lines is substantially rectangular or of isosceles trapezoid:

the first virtual line connects centers of projection images of the first light-source portions on one side and on the other side;

the second virtual line connects centers of projection images of the first light-source portion on the other side and the second light-source portion on one side;

the third virtual line connects centers of projection images of the second light-source portions on one side and on the other side; and the fourth virtual line connects centers of projection images of the second light-source portion on the other side and the first light-source portion on one side.

10. An image-reading apparatus, comprising the illuminating device according to claim 1.

11. Image-forming equipment, comprising the image-reading apparatus according to claim 10.

12. An illuminating device that illuminates an object, comprising:

a light-source portion on one side;

a light-source portion on the other side; and a long translucent light-guiding member having a light-discharging face long in a longitudinal direction thereof, and guiding light derived from the one light-source portion from one end face in the longitudinal direction, and light derived from the other light-source portion from the other end face in the longitudinal direction so that the guided light is irradiated to an object through the long light-discharging face;

wherein the one and the other light-source portions are arranged such that positions of optical axes thereof differ from each other;

further comprising a main reflecting member that reflects light in the light-guiding member one light-source support on which the one light-source portion is set up;

one light-source support on which the one light-source portion is set up;

the other light-source support on which the other light-source portion is set up; and a base member;

wherein:

the base member supports the one light-source support at the one end face in the longitudinal direction of the light-guiding member, and the other light-source support at the other end face in the longitudinal direction of the light-guiding member, and the one and the other light-source portions are respectively set up on the one and the other light-source supports so that the positions of the optical axes of the one and the other light-source portions differ from each other;

the one light-source portion includes a first light-source portion and a second light-source portion on the one side, which are set up on the one light-source support;

the other light-source portion includes a first light-source portion and a second light-source portion on the other side, which are set up on the other light-source support;

the light-guiding member includes a first light-guiding member and a second light-guiding member that are arranged side by side in a direction that is perpendicular to the longitudinal direction such that these end faces in the longitudinal direction thereof are aligned with each other;

the base member has a slit through which the light reflected from the object pass, between the first and the second light-guiding members, the slit extending in the longitudinal direction, and the base member supports the one light-source support at the one end face in the longitudinal direction of the first and the second light-guiding members, and the other light-source support at the other end face in the longitudinal direction of the first and the second light-guiding members;

the main reflecting member includes a first main reflecting member that reflects light in the first light-guiding member and a second main reflecting member that reflects light in the second light-guiding member;

the first light-source portions on the one side and on the other side are respectively arranged on the one and the other light-source supports such that positions of the optical axes of the first light-source portions respectively differ from each other;

the second light-source portions on the one side and on the other side are respectively arranged on the one and the other light-source supports such that positions of the optical axes of the second light-source portions respectively differ from each other; and wherein, when the first light-source portion on one side is closer to the object than the first light-source portion on the other side, the second light-source portion on the other side is closer to the object than the second light-source portion on one side, the second light-source portion on one side is positioned farther from the object than the first light-source portion on one side, and the first light-source portion on the other side is positioned farther from the object than the second light-source portion on the other side, or wherein, when the first light-source portion on one side is farther from the object than the first light-source portion on the other side, the second light-source portion on the other side is farther from the object than the second light-source portion on one side, the second light-source portion on one side is positioned closer to the object than the first light-source portion on one side, and the first light-source portion on the other side is positioned closer to the object than the second light-source portion on the other side.

13. The illuminating device according to claim 12, wherein, when viewed from the longitudinal direction of the first and the second light-guiding members, a shape defined by four virtual lines is substantially rectangular or of isosceles trapezoid:

the first virtual line connects centers of projection images of the first light-source portions on one side and on the other side;

the second virtual line connects centers of projection images of the first light-source portion on the other side and the second light-source portion on one side;

the third virtual line connects centers of projection images of the second light-source portions on one side and on the other side; and the fourth virtual line connects centers of projection images of the second light-source portion on the other side and the first light-source portion on one side.

* * * * *